US007985518B2

(12) United States Patent
Shu et al.

(10) Patent No.: US 7,985,518 B2
(45) Date of Patent: Jul. 26, 2011

(54) TONER, IMAGE FORMING APPARATUS USING THE SAME, AND IMAGE FORMING METHOD

(75) Inventors: Hyo Shu, Mishima (JP); Mitsuo Aoki, Numazu (JP); Minoru Masuda, Numazu (JP); Kumi Hasegawa, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/263,512

(22) Filed: Nov. 3, 2008

(65) Prior Publication Data

US 2009/0123857 A1 May 14, 2009

Related U.S. Application Data

(62) Division of application No. 11/223,998, filed on Sep. 13, 2005, now abandoned.

(30) Foreign Application Priority Data

Sep. 13, 2004 (JP) ..... 2004-264908

(51) Int. Cl.
*G03G 15/01* (2006.01)

(52) U.S. Cl. ..... 430/45.5; 430/47.2

(58) Field of Classification Search ..... 430/45.5, 430/47.2

See application file for complete search history.

(56) References Cited

U.S. PATENT DOCUMENTS

| | | | | |
|---|---|---|---|---|
| 6,593,048 | B2 | 7/2003 | Sasaki et al. | |
| 6,620,566 | B1 | 9/2003 | Yamauchi | |
| 6,667,141 | B2 | 12/2003 | Iwamoto et al. | |
| 6,699,632 | B2 | 3/2004 | Higuchi et al. | |
| 6,790,575 | B2 | 9/2004 | Sasaki et al. | |
| 6,818,369 | B2 | 11/2004 | Sugiura et al. | |
| 6,828,075 | B2 | 12/2004 | Suzuki et al. | |
| 6,835,517 | B2 | 12/2004 | Kondo et al. | |
| 6,855,471 | B2 * | 2/2005 | Katsuta et al. | 430/108.23 |
| 6,856,781 | B2 | 2/2005 | Matsuda et al. | |
| 6,861,191 | B2 | 3/2005 | Mochizuki et al. | |
| 6,887,636 | B2 | 5/2005 | Matsuda et al. | |
| 6,899,986 | B2 | 5/2005 | Aoki et al. | |
| 6,934,484 | B2 | 8/2005 | Suzuki et al. | |
| 2003/0129510 | A1 | 7/2003 | Hagi et al. | |
| 2003/0152857 | A1 | 8/2003 | Sugiura et al. | |
| 2003/0232266 | A1 | 12/2003 | Sugiura et al. | |
| 2004/0146309 | A1 | 7/2004 | Shu et al. | |
| 2004/0157147 | A1 | 8/2004 | Shiraishi et al. | |
| 2004/0234879 | A1 | 11/2004 | Hasegawa et al. | |
| 2005/0064310 | A1 | 3/2005 | Masuda et al. | |
| 2005/0079430 | A1 | 4/2005 | Aoki et al. | |

FOREIGN PATENT DOCUMENTS

| | | | |
|---|---|---|---|
| EP | 1 237 047 | A1 | 9/2002 |
| EP | 1 327 914 | A2 | 7/2003 |
| EP | 1 331 520 | A1 | 7/2003 |
| JP | 11-272014 | | 10/1999 |
| JP | 11-295932 | | 10/1999 |
| JP | 2000-206755 | A | 7/2000 |
| JP | 2001-249498 | | 9/2001 |
| JP | 2002-372831 | | 12/2002 |
| JP | 2003-114547 | | 4/2003 |
| JP | 2003-149869 | | 5/2003 |
| JP | 2003-215847 | | 7/2003 |
| JP | 2003-223018 | | 8/2003 |
| JP | 2004-77664 | | 3/2004 |
| JP | 2004-138727 | | 5/2004 |
| JP | 2004-184721 | | 7/2004 |
| JP | 2005-215592 | | 8/2005 |

OTHER PUBLICATIONS

Diamond, Arthur S. & David Weiss (eds.) Handbook of Imaging Materials, 2nd ed.. New York: Marcel-Dekker, Inc. (Nov. 2001), pp. 145-164.

English language translation of JP 2000-206755 (2000).

* cited by examiner

*Primary Examiner* — Christopher RoDee

(74) *Attorney, Agent, or Firm* — Oblon, Spivak, McClelland, Maier & Neustadt, L.L.P.

(57) ABSTRACT

An image forming apparatus of the present invention includes a latent electrostatic image bearing member, a latent electrostatic image forming unit configured to form a latent electrostatic image on the latent electrostatic image bearing member, at least three developing units each configured to develop the latent electrostatic image using a toner to form a visible image, a transferring unit configured to transfer the visible image on a recording medium, and an image fixing unit configured to the transferred image on the recording medium, in which the developing units respectively include any one of a yellow toner, a magenta toner, and a cyan toner, the magenta toner includes C.I. pigment red 269, and the yellow toner includes C.I pigment yellow 180 or C.I pigment yellow 155.

3 Claims, 8 Drawing Sheets

TONER, IMAGE FORMING APPARATUS USING THE SAME, AND IMAGE FORMING METHOD

CROSS REFERENCE TO RELATED APPLICATIONS

The present application is a Divisional of U.S. application Ser. No. 11/223,998, filed Sep. 13, 2005 now abandoned, the entire contents of which are hereby incorporated by reference.

BACKGROUND OF THE INVENTION

1. Field of the Invention

The present invention relates to an image forming apparatus for forming color images based on electrostatic copying processes such as copiers, facsimiles, and printers. The present invention further relates to a toner used for the color image forming, an image forming apparatus using the toner, and an image forming method thereof.

2. Description of the Related Art

In image forming based on an electrophotographic process, a latent image is formed by means of electrostatic charge on an image bearing member having a photosensitive layer which comprises photoconductive substances and the like, charged toner particles are adhered on the latent electrostatic image to form a visible image, and then the visible image is transferred onto a recording medium such as paper and fixed on the recording medium to be an output image. In recent years, there have been rapid developments from monochrome image technologies toward full color image technologies of copiers and printers using electrophotographic processes, and the market of full color image technologies increasingly tends to expand. Typically, in color image forming based on a full color electrophotographic process, all colors are reproduced by superimposing three color toners of yellow, magenta, and cyan which are three primary colors or four color toners with black color toner added to the three primary colors. Therefore, to obtain a full color image having excellence in color-reproductively and color vividness, the surface of the fixed toner image must be smoothed and evened to some extent to reduce scattering of light. For this reason, there were so many conventional types of full color copiers or the like which have a middle level of image glossiness to high level image glossiness of 10% to 50%.

In color image forming based on an image developing method using a two-component developer, when the developer is stirred, toner particles are fixed and flocculated each other by compression force worked among carriers. In color image forming based on an image developing method using a one-component developer, toner particles are flocculated each other by pressure, frictional force or the like when the toner is made into a thin layer on a developing roller. In both two-component developing method and one-component developing method, a toner is semi-molten to cause toner-fixed aggregate by heat generated from friction of axes such as mixing fans and screws when mixing the developer. The toner-fixed aggregate is developed on or attached to an image to appear as thick and not-small spots on the image. When the image is transferred onto a paper sheet, the toner-fixed aggregate serves as a spacer between the paper sheet and a photoconductor, resulting in a loss of color of the image at that portion into white color. Particularly in color images, abnormal images easily stand out when comparing with monochrome images, and high resolution images having fine-textured tones and fine color reproductivity are required, and therefore abnormal images brought about by such a toner-fixed aggregate has become an issue. In particular, quality of color images is substantially affected by magenta colorants from the viewpoint of the relative luminous efficiency of humans.

For example, Japanese Patent Application Laid-Open (JP-A) No. 2004-77664 discloses a magenta toner for developing electrostatic images which comprises a colorant in which the colorant is a predetermined compound, and the toner is produced by dissolving a toner composition containing a modified polyester resin capable of a urea-binding in an organic solvent, subjecting the toner composition to a polyaddition reaction in an aqueous medium, and rinsing the dispersion liquid to remove the solvent from the dispersion liquid. In addition, Japanese Patent Application Laid-Open (JP-A) No. 2003-215847 discloses a magenta toner for electrophotography which comprises a binder resin and a colorant, in which the colorant comprises a naphthol pigment having a predetermined structure, the shape factor SF-1 of the toner is 110 to 140, and the volume average particle diameter of the toner is 2 μm to 9 μm. However, there is no disclosure in the invention on improvements in color reproduction in red color region through the use of the combination of specific naphthol pigments and a specific yellow pigment.

As for a method for fixing a toner image on a recording medium, the following image fixing method is often used, in which an image fixing roller or an image fixing belt having a smooth surface is heated and pressed firmly to a toner to thereby fix a toner image. This method has advantages of having high thermal conductivity and enabling high-speed fixing and imparting gloss and transparency to color toners, while it causes so-called offset phenomenon in which part of a toner image adheres to the surface of a fixing roller and spreads to other images, because a surface of a heating and fixing member is made contact with a molten toner under pressures and then they are isolated from each other. With a view to preventing the offset phenomenon, the following method is typically employed, in which a surface of a fixing roller is formed with silicone rubber and fluororesin each having excellent releasing property, and a releasing oil such as silicone oil is further coated on the surface of the fixing roller. This method is fairly effective in terms of preventing offset phenomenon of toners, however, it requires a device for supplying a releasing oil, and a large-sized image fixing unit must be prepared, resulting in high cost. Therefore, for monochrome toners, the following method tends to be widely used, in which viscoelasticy of a fused toner is enhanced so that the fused toner particles are not is broken internally by controlling the distribution of molecular mass of a binder resin, and no releasing oil is coated on a surface of a fixing roller or only a minute amount of releasing oil is used and coated thereon by adding a releasing agent such as wax in the toner.

However, in color toners, viscoelasticy of a molten toner must be lowered, because it is necessary to smooth a surface of a fixed image to improve color reproductivity. Color toners are more likely to cause offset phenomena than in monochrome toners which have no glossiness, and it is much more difficult to use an oilless toner in an image fixing unit and to use a minute amount of a releasing oil to coat a surface of a fixing roller. In addition, when a releasing agent is included in a toner, adhesive strength of toner increases and transferring properties of toner against a transferring sheet degrades, causing a problem that interior part of an image forming apparatus is smeared because the releasing agent in the toner contaminates frictional electrification members such as carriers, and charge properties of the toner degrades.

SUMMARY OF THE INVENTION

It is therefore an object of the present invention is to provide a toner causing little toner scattering in image forming apparatuses while allowing for color reproductivity of red colors which substantially affect the quality of color images and to provide an image forming apparatus using the toner as well as an image forming method thereof.

An image forming apparatus of the present invention comprises a latent electrostatic image bearing member; a latent electrostatic image forming unit configured to form a latent electrostatic image on the latent electrostatic image bearing member; at least three developing units each configured to develop the latent electrostatic image using a toner to form a visible image; a transferring unit configured to transfer the visible image onto a recording medium; and a fixing unit configured to fix the transferred image on the recording medium.

The developing units respectively comprise any one of a yellow toner, a magenta toner, and a cyan toner.

The magenta toner comprises a pigment represented by the following Structural Formula (1), and the yellow toner comprises a pigment represented by at least at least any one of the following Structural Formulas (2) and (3).

In this case, preferably, an aspect of the image forming apparatus is an image forming apparatus in which multiple color toners are sequentially superimposed to form a color image; an aspect of the image forming apparatus is a tandem type image forming apparatus which comprises three or more image forming elements each of which comprises a latent electrostatic image bearing member, a latent electrostatic image forming unit, a developing unit, and a transferring unit; and an aspect of the image forming apparatus in which the fixing unit comprises a fixing belt spanned over a plurality of rollers, and a pressure roller.

Preferably, an aspect of the image forming apparatus in which the image forming apparatus forms a visible image in which a yellow toner layer is formed on a magenta toner layer; an aspect of the image forming apparatus in which the cyan toner comprises a copper phthalocyanine pigment; and an aspect of the image forming apparatus in which the image forming apparatus further comprises a developing unit which comprises a black toner.

Preferably, an aspect of the image forming apparatus in which the image forming apparatus uses a magenta toner having a value L* ranging from 45 to 60, a value a* ranging from 55 to 75, and a value b* ranging from −8 to 0 when the ID according to X-RITE938 $D50^2$ in the color specification system of L*a*b* after image fixing in a monochrome color is set to 1.00; an aspect of the image forming apparatus in Structural Formula (1)

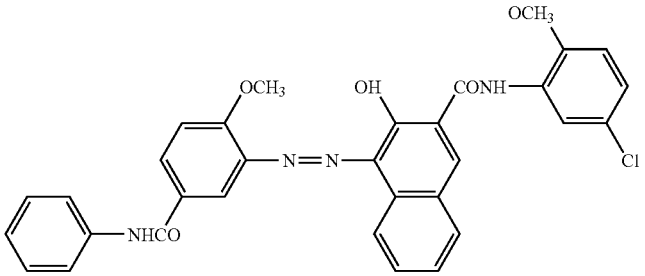

C.I. pigment red 269

Structural Formula (2)

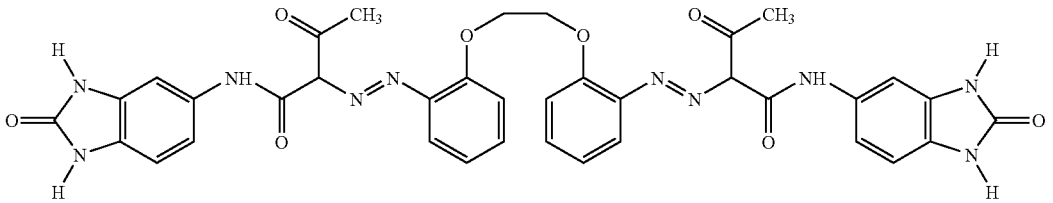

C.I. pigment yellow 180

Structural Formula (3)

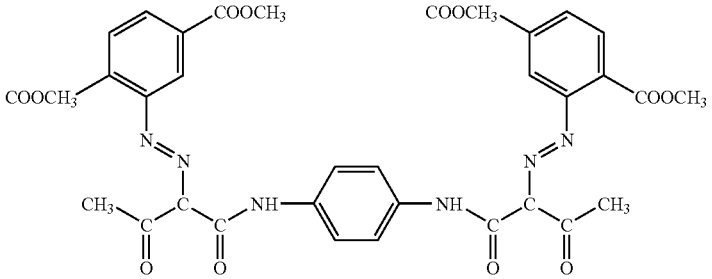

C.I. pigment yellow 155 which the image forming apparatus uses a yellow toner having a value L* ranging from 82 to 92, a value a* ranging from −12 to −2, and a value b* ranging from 67 to 90 when the ID according to X-RITE938 $D50^2$ in the color specification system of L*a*b* after image fixing in a monochrome color is set to 1.00; and an aspect of the image forming apparatus in which the image forming apparatus uses a mixed color of a magenta toner and a yellow toner each having a value L* ranging from 42 to 48, a value a* ranging from 60 to 68, and a value b* ranging from 46 to 55 in the color specification system of L*a*b* after image fixing in the mixed color when the ID according to X-RITE938 $D50^2$ in the color specification system of L*a*b* after image fixing in respective monochrome colors of magenta toner and yellow toner is set as 1.00.

In addition, preferably, an aspect of the image forming apparatus comprises a detachable process cartridge in which a latent electrostatic image bearing member and at least one selected from charging unit, developing unit, and a cleaning unit are held integrally.

An image forming method of the present invention comprises forming a latent electrostatic image on a latent electrostatic image bearing member; developing the latent electrostatic image using a toner to form a visible image; transferring the visible image onto a recording medium; and fixing the transferred image on the recording medium.

The image forming method comprises three or more developing steps.

Developing units in the three developing steps respectively comprise any one of a yellow toner, a magenta toner, and a cyan toner.

The magenta toner comprises a pigment represented by Structural Formula (1), and the yellow toner comprises a pigment represented by at least any one of Structural Formulas (2) and (3).

A toner of the present invention is used for an image forming apparatus which comprises a latent electrostatic image bearing member; a latent electrostatic image forming unit configured to form a latent electrostatic image on the latent electrostatic image bearing member; at least three developing units configured to develop the latent electrostatic image to form a visible image by using a toner; a transferring unit configured to transfer the visible image onto a recording medium; and a fixing unit configured to fix the transferred image on the recording medium and to thereby form a color visible image on the recording medium.

At least three developing units stated above respectively comprise a yellow toner, a magenta toner, and a cyan toner.

The magenta toner comprises a pigment represented by Structural Formula (1), and the yellow toner comprises a pigment represented by at least any one of Structural Formulas (2) and (3).

Figure 1A:
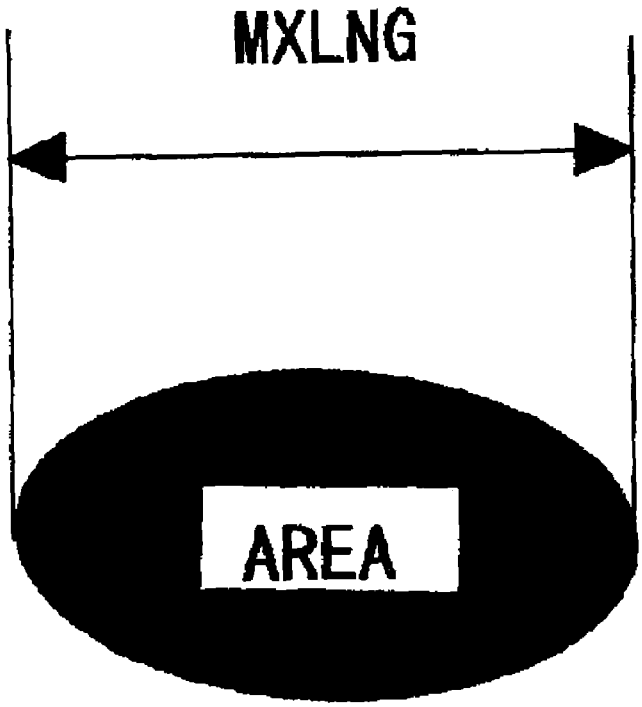
FIG. 1A is a schematic view exemplarily showing a toner shape for explaining a toner shape factor SF-1.

DESCRIPTION OF THE PREFERRED EMBODIMENTS (Image Forming Apparatus and Image Forming Method)

The image forming method according to the present invention includes at least latent electrostatic image forming, developing, transferring, and fixing, and further includes other steps selected in accordance with the intended use such as charge-eliminating, cleaning, recycling, and controlling.

The image forming apparatus of the present invention comprises a latent electrostatic image bearing member, a latent electrostatic image forming unit, a developing unit, a transferring unit, and a fixing unit, and further comprises other units selected in accordance with the necessity, such as a charge-eliminating unit, a cleaning unit, a recycling unit, and a controlling unit.

The latent electrostatic image forming is a step for forming a latent electrostatic image on a latent electrostatic image bearing member.

The latent electrostatic image bearing member which may be herein referred to as electrophotoconductor, photoconductor or image bearing member, is not particularly limited as to the material, shape, structure, size, and the like and may be selected those known in the art in accordance with the necessity. The latent electrostatic image bearing member is preferably a drum-like in shape, and the examples of the materials include inorganic photoconductors such as amorphous silicons, and seleniums; and OPC or organic photoconductors such as polysilanes, and phthalo polymethines. Among these materials, amorphous silicons or the like are preferred in terms of the longer operating life.

The latent electrostatic image can be formed by charging the surface of the latent electrostatic image bearing member uniformly and then exposing the surface image wisely, by means of the latent electrostatic image forming unit.

The latent electrostatic image forming unit comprises, for example, a charger for charging the surface of the latent electrostatic image bearing member uniformly and an exposing unit for exposing the surface of the latent electrostatic image bearing member imagewise.

The charging can be performed by applying electric voltage to the surface of the latent electrostatic image bearing member using, for example, the charger.

The charger is not particularly limited and may be selected in accordance with the intended use. Examples of the charger include a contact type chargers known in the art equipped with conductive or semi-conductive roll, brush, film, rubber blade, or the like; and noncontact-type chargers which utilizes corona discharge such as corotron, and scorotron.

Preferably the charger is arranged in contact with and in non-contact with a latent electrostatic image bearing member to charge the surface of the latent electrostatic image bearing member by overlappingly applying a direct current voltage and alternating voltage.

The charger is also preferably a charge roller which is arranged near and in non-contact with a latent electrostatic image bearing member through a gap tape, in which the surface of the latent electrostatic image bearing member is charged by overlappingly applying a direct current voltage and alternating voltage to the charge roller.

The exposures can be performed by exposing the surface of the latent electrostatic image bearing member image wisely using, for example, the exposer.

The exposer is not particularly limited, provided that exposures can be performed image wisely, as in the appearance of the image to be formed, on the surface of the latent electrostatic image bearing member, and it may be selected in accordance with the intended use. For example, there are various types of exposers such as photocopy optical systems, rod lens array systems, laser beam systems, and liquid-crystal shutter optical systems.

In the present invention, an optical backside process may be employed, in which exposures are performed imagewise from the back side of the latent electrostatic image bearing member.

-Developing Step and Developing Unit-

The developing step includes at least three developing steps, and the developing is a step for developing the latent electrostatic image using the toner and the developer to develop the image into a visible image.

The visible image can be formed by developing the latent electrostatic image using, for example, the toner and the developer of the present invention and by means of the developing unit.

The developing unit includes at least three developing units, and the at least three developing units are not particularly limited, provided that images can be developed using the toner and the developer according to the present invention, and may be selected from those known in the art in accordance with the necessity. Examples of the preferred developing unit include the one that comprises the toner and the developer and comprises an image developing apparatus which can supply the developer in contact with or in non-contact with the latent electrostatic image.

The image developing apparatus may be based on a dry-developing process or a wet-developing process, and also may be the one for monochrome or for multicolor. For example, an image developing apparatus which comprises an agitator for frictionizing and agitating the toner and the developer to be charged; and a rotatable magnet roller, is preferable.

In the image developing apparatus, for example, the toner and carriers are mixed and agitated, and the toner is charged by friction at that time to be held in the state where the toner is standing on the surface of the rotating magnet roller to form a magnetic brush. Since the magnet roller is disposed near the latent electrostatic image bearing member, i.e. the photoconductor, a part of the toner constituting the magnet brush formed on the surface of the magnet roller moves onto the surface of the latent electrostatic image bearing member by electrical attraction force. As a result, the latent electrostatic image is developed through the use of the toner to form a visible image which comprises the toner on the surface of the latent electrostatic image bearing member.

A developer to be held in the image developing apparatus is the one that includes the toner and the developer.

The image forming apparatus is preferably the one that plural color toners are sequentially superimposed to form a color image.

In addition, the image forming apparatus is preferably a tandem image forming apparatus which comprises three or more image forming elements each including a latent electrostatic image bearing member, a latent electrostatic image forming unit, a developing unit and transferring unit.

An image forming apparatus according to the present invention comprises at least three developing units, in which the developing units respectively comprise any one of a yellow toner, a magenta toner, and a cyan toner to form a color image, a color visible image on the recording medium is formed by at least the yellow toner, the magenta toner, and cyan toner, in which the magenta toner comprises an organic pigment represented by the following Structural Formula (1), and the yellow toner comprises an organic pigment represented by at least any one of the following Structural Formulas (2) and (3).

Structural Formula (1)

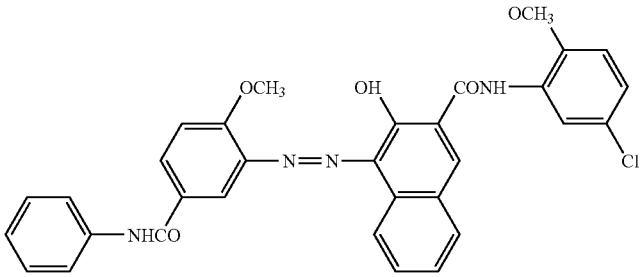

C.I. pigment red 269

Structural Formula (2)

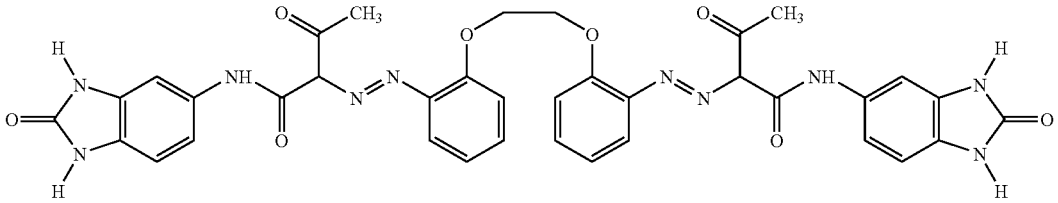

C.I. pigment yellow 180

-continued

Structural Formula (3)

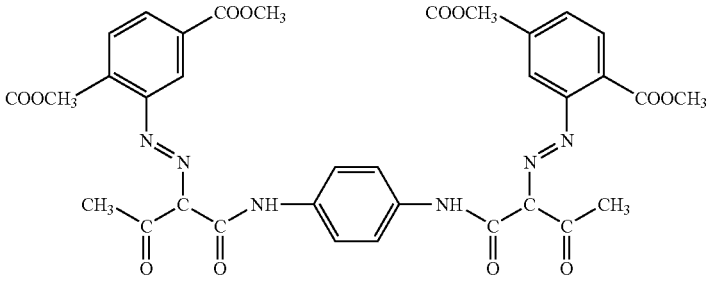

C.I. pigment yellow 155

Preferably, the image forming apparatus further comprises a developing unit in which a black toner is included besides the three developing units.

Organic pigments represented by Structural Formula (1) as the magenta toner are azo lake pigments. As a pigment for the magenta toner, azo pigments such as azo lake pigments, insoluble azo pigments; and organic pigments such as quinacridone polycyclic pigments have been used so far. Azo pigments include naphthol pigments and oxynaphthoe acid pigments, of which naphthol pigments such as C.I. pigment red 49, C.I. pigment red 68, and C.I. pigment red 184 have been used so far. As quinacridone pigments, C.I. pigment red 122, C.I. pigment red 209, and C.I. pigment red 206 have been used so far.

However, for the magenta toner used for the image forming apparatus of the present invention, oxynaphthoe acid pigments of organic pigments represented by Structural Formula (1), C.I. pigment red 269 is used. This pigment reproduces brilliant magenta colors because it has a narrow absorption band at the wavelengths of 500 nm to 600 nm. Particularly, when the ID according to X-RITE938 ($D50^2$) densitometer after fixing an image to a recording medium such as a transferring sheet, and a film sheet is set to 1.00, the magenta toner has a value L* ranging from 45 to 60, a value a* ranging from 55 to 75, and a value b* ranging from −8 to 0 in the color specification system of L*a*b*, CIE1976. These values are obtained through the use of uniform measurements in which color density is measured through a complementary color filter to keep the color density given to humans at a constant state. When the value L* is less than 45, it shows a subdued dark color and when the toner is mixed with another color toner, color reproductivity of neutral colors degrades. In the case of a monochrome color having a value L* being more than 60, it is whitish color tone, and similarly, when mixed with another color toner, color reproductivity of neutral colors degrades. When the value a* is less than 55 and the toner is mixed with another color toner, color reproductivity of neutral colors degrades. When the value b* is more than zero and the toner is mixed with another color toner, color reproductivity of neutral colors degrades. When the value a* is more than 75, the content of the pigment must be increased, resulting in an increased opacifying power of the toner and when mixed with another color toner, color reproductivity of neutral colors degrades. When the value b* is less than −8, the content of the pigment must be increased, resulting in an increased opacifying power of the toner and when mixed with another color toner, color reproductivity of neutral colors degrades.

As just described, this magenta pigment is capable of reproducing brilliant magenta colors as well as exhibiting a wide range of color reproductivity when mixed with other color toners, because it has a narrow absorption band of wavelengths.

This yellow toner is a toner in which the yellow toner comprises organic pigments represented by at least any one of Structural Formulas (2) and (3). Both organic pigments are insoluble azo pigments. For yellow toners, azo organic pigments such as acetoacetic acid allylid dis-azo pigments, acetoacetic acid imidazolon pigments; and polycyclic organic pigments such as quinacridone pigments, and threne pigments have been used so far. Particularly, acetoacetic acid allylid dis-azo pigments C.I. pigment yellow 13 and C.I. pigment yellow 17 have been widely used. However, for yellow toners used for the image forming apparatus of the present invention, organic pigments represented by Structural Formula (2), i.e. C.I. pigment yellow 180 disazo organic pigment and/or organic pigments represented by Structural Formula (3), i.e. C.I. pigment yellow 155 dis-azo organic pigment are used. These pigments are halogen-free and reproduces brilliant yellow colors because they respectively have a narrow absorption band at wavelengths of 400 nm to 500 nm.

Particularly, when the ID according to X-RITE938 ($D50^2$) densitometer after fixing an image to a recording medium such as a transferring sheet, and a film sheet is set to 1.00, the yellow toner has a value L* ranging from 82 to 92, a value a* ranging from −12 to −2, and a value b* ranging from 67 to 90 in the color specification system of L*a*b*, CIE1976. These values are obtained through the use of uniform measurements in which color density is measured through a complementary color filter to keep the color density given to humans at a constant state. When the value L* is less than 82, it shows a subdued dark color and when the toner is mixed with another color toner, color reproductivity of neutral colors degrades. In the case of a monochrome color having a value L* being more than 92, it is whitish color tone, and it is hard to exhibit color reproductivity in the monochrome color. When the value a* is more than −2 and the toner is mixed with another color toner, color reproductivity of neutral colors degrades. When the value b* is less than 67 and the toner is mixed with another color toner, color reproductivity of neutral colors degrades. When the value a* is less than −12, the content of the pigment must be increased, resulting in an increased opacifying power of the toner and when mixed with another color toner, color reproductivity of neutral colors degrades. When the value b* is more than 90, the content of the pigment must be increased, resulting in an increased opacifying power of the toner and when mixed with another color toner, color reproductivity of neutral colors degrades.

As just described, this yellow pigment is capable of reproducing brilliant yellow colors as well as exhibiting a wide range of color reproductivity when mixed with other color toners, because it has a narrow absorption band of wavelengths.

By mixing the magenta toner and the yellow toner, red (R) colors are reproduced, however, when the ID according to X-RITE938 ($D50^2$) densitometer after respectively fixing images of each of the magenta toner and the yellow toner in their monochrome color is set to 1.00, the mixed color has a value L* ranging from 42 to 48, a value a* ranging from 60 to 68, and a value b* ranging from 46 to 55 in the color specification system of L*a*b*, CIE1976. The respective ranges of color reproductivity in the L*a*b* color specification system can be adjusted by the contents of the magenta toner and the yellow toner, the amount of toner adhered during the developing and transferring and the like, however, the color reproduction range of red colors can be widen from skin color to vermillion by setting respective values of L*a*b* to the above ranges. In this case, the values of L*a*b* color specification system of the mixed color are represented by forming solid parts of red color using a magenta toner, a yellow toner, and mixed color toner thereof. When the value L* is less than 42, it shows a subdued dark color, and bright red colors cannot be reproduced. When the value L* is more than 48, it is whitish color tone, and the range where red colors can be reproduced is narrow. When the value a* is less than 60, the range where red colors can be reproduced is narrow, and various red colors in neutral colors cannot be reproduced. When the value b* is less than 46, the range where red colors can be reproduced is narrow, and various red colors in neutral colors cannot be reproduced. While the value a* is more than 68, the content of the pigment must be increased, resulting in an increased opacifying power of the toner, and similarly, various red colors in neutral colors cannot be reproduced. When the value b* is more than 55, the content of the pigment must be increased, resulting in an increased opacifying power of the toner, and similarly, various red colors in neutral colors cannot be reproduced. Reproduction of red colors is important when expressing appearance of humans and other things, however, the transparency is low because a lager amount of organic pigments are used therein compared to those used in photographic paper and sublimation type such as photographs. Particularly when the opacifying power is large, the color reproductivity of red colors has been lowered because the color reproduction range of red colors in neutral colors is narrow. In the image forming apparatus of the present invention, it was possible to reproduce brilliant red (R) colors in neutral colors as well as to obtain a wide range of red color reproductivity by using a magenta toner which comprises a colorant represented by Structural Formula (1) in combination with a yellow toner which comprises a yellow colorant represented by at least any one of Structural Formula (2) and Structural Formula (3).

When mixing a magenta toner and a yellow toner, in a visible image on the recording medium, a magenta toner layer is formed under a yellow toner. This is preferable from the perspective of widening the color reproduction range of red colors. This structure is taken because the yellow colorants used in the present invention which are represented by at least any one of Structural Formula (2) and Structural Formula (3) have a low opacifying power and cannot hide organic colorants which are formed under the yellow toners. In particular, a wider range of color reproductivity of red colors was possible by using a magenta toner which comprises a magenta colorant represented by Structural Formula (1) under the yellow toner.

When a cyan toner of C.I. pigment blue 15:3 being a copper phthalocyanine pigment is mixed with a magenta toner C.I. pigment red 269, the color reproduction range of blue colors is widened.

Although the absorption band of C.I. pigment red 269 is narrow, a wider range of color reproductivity can be obtained even when mixed with other colorants. Further, when a cyan toner of C.I. pigment blue 15:3 being a copper phthalocyanine pigment is mixed with yellow toners C.I. pigment yellow 180 and/or C.I. pigment yellow 155, similarly, it is possible to widen the color reproductivity of green colors.

In addition, it is preferred to use a toner which comprises a releasing agent in the image forming apparatus of the present invention. As a means to prevent hot-offset which causes some problems in the fixing of image forming method, there is a method in which a releasing agent is included in a toner. A releasing agent included in a toner is present in the surface of the toner and develops its releasing properties of releasing from a fixing member along with transformation of the toner due to subjecting to heat and pressure in fixing. Further, when a releasing agent is included in a toner, the color reproductivity is much more improved because the surface of the toner layer after an image fixed is smoother. This is because when the difference between the melting start temperature and the melting end temperature is small, like releasing agents, the toner layer begins to be solidified when isolating from a fixing belt and a fixing roller which are heating-rotators. Thus the surface of the toner smoothes and a brilliant color image having high glossiness can be obtained. Such a releasing agent is preferably included in the toner surface not exposed on the toner surface.

Further, in the toner used in the image forming apparatus of the present invention, since a releasing agent is exposed on the toner surface, it inhibits frictional charging properties acting on with magnetic carriers, however, a magenta colorant used in this invention has more excellent charge properties compared to those of conventional quinacridone colorants. Thus, even when a releasing agent is exposed on the toner surface, the toner has excellent charge properties, and even when image forming operation is performed in long hours, background smears of toner are not printed on images, and there is no smear in a copier due to toner scattering within an image forming apparatus.

For the releasing agent, a wax having a melting point of 50° C. to 120° C. which is dispersed in a binder resin more effectively works on the phase boundary between a fixing roller or a fixing belt and a toner as a releasing agent in a dispersion liquid with a binder resin dispersed therein, which exert effect on high temperature offsets without any applications of a releasing agent to a fixing roller. The wax components are as follows. Examples of the wax include vegetable waxes such as carnauba waxes, cotton waxes, Japanese waxes, and rice waxes; animal waxes such as beeswaxes, and lanoline waxes, and mineral waxes such as ozokerites, and ceresins, and petroleum waxes such as paraffins, micro crystallines, and petrolatums. Besides the above-noted permanent waxes, there are hydrocarbon synthetic waxes such as Fischer-Tropsch waxes, and polyethylene waxes; and synthetic waxes such as ester wax, ketone waxes, and ether waxes. Further, it is also possible to use fatty acid amides such as 12-hydroxy stearic acid amides, stearic acid amide, phthalic anhydride imide, and chlorinated hydrocarbons; and crystalline polymers having a long alkyl group in its side chain such as homopolymers or copolymers of polyacrylate such as poly-n-stearyl methacrylate, and poly-n-lauryl methacrylate which are low-molecular mass crystalline polymer resins.

In addition, in the image forming apparatus of the present invention, the average circularity of the toner is preferably 0.92 or more. This is preferable from the perspective of obtaining high quality images because a toner formed as the above exhibits excellent dot reproductivity and excellent transferring properties. Since the toner has a high average circularity, the toner is uniformly developed and transferred, and the toner has few cases where the toner adheres in block to halftone parts and solid parts of an image, and the toner is uniformly distributed. With the above configurations, when multiple toner colors are superimposed in a laminar structure, uniform neutral colors with less uneven distribution of the colors can be reproduced and further a wider color reproduction range is possible. The average circularity of the toner is more preferably 0.94 or more. When the average circularity is less than 0.92 and the toner has a shape dissimilar to a spherical shape, it is hard to obtain adequate transferring properties or high quality images without transferring dust. Such a toner particle formed in indefinite shape has many contact surface points contacting a photoconductor or the like and the adherence force derived from van der Waals force, and image force is higher than a toner particle formed in a substantially spherical shape because electrical charges are concentrated on the tip of projected area of the toner. Therefore, in an electrostatic transferring step, with a toner with toner particles formed in indefinite shape and toner particles formed in substantially spherical shape mixed therein, the toner particles formed in substantially spherical shape selectively moves to an image, resulting in omitted portions of the image in characters and lines. It needs a cleaner, the residual toner particles must be cleaned for the subsequent developing of images, and it brings about a problem that the toner-yield or the rate of toner particles used for image forming is low.

Preferably, the ratio of toner particles having an average circularity less than 0.91 is 30% or less. It is not preferred to use a toner with the average circularity varying widely like the one that the ratio is more than 30%, because the charge rate and charge level widely vary, and the distribution of the amount of charge is wider.

The average circularity of the toner is a value obtained by optically detecting toner particles, and the circumferential length of a circle which has an area equivalent to the projection area of the toner is divided by a circumferential length of an actual toner particle.

Specifically, the average circularity of the toner is measured using a flow particle image analyzer (FPIA-2000; manufactured by Sysmex Corp.). To a given vessel, 100 ml to 150 ml of water with impure solid matters preliminarily removed is placed, 0.1 ml to 0.5 ml of a surface active agent is added as a dispersant, and about 0.1 g to 9.5 g of a sample of a toner is further added. The suspension with the sample dispersed therein was subjected to dispersion for approx. 1 minute to 3 minutes in an ultrasonic dispersing apparatus to make a concentration of the dispersant 3,000 number of pieces/μL to 10,000 number of pieces/μL to measure the shape and distribution of the toner.

In addition, in the image forming apparatus of the present invention, it is preferred to use a toner having a volume average particle diameter of 3.0 μm to 8.0 μm, and a ratio Dv/Dn of the volume average particle diameter Dv to the number average particle diameter Dn of 1.00 to 1.40. More preferably, the volume average particle diameter is 3.0 μm to 7.0 μm, and the ratio Dv/Dn is 1.00 to 1.25. By using a toner formed within the ranges, brilliant color images having a large color reproduction range of neutral colors and a narrow absorption band can be obtained in full-color images.

It is said that the smaller the toner particle diameter is, the more advantageous to obtain high quality of image at high resolutions. Conversely, it is disadvantageous to transferring properties and cleaning ability. When the volume average particle diameter is smaller than the minimum of this range, when used as a tow-component developer, the toner is fused on surfaces of magnetic carriers in long-hours agitation in a developing unit, resulting in lowered charging performance of the magnetic carriers, and when used as a one-component developer, it easily cause filming of the toner to a developing roller, and the toner is easily fused to members for forming the toner in a thin layer such as a blade. These phenomena are largely concerned with the content of fine particles, and particularly when toner particles having a toner particle diameter of 3 μm or less are more than 10%, it causes problems with adherence to magnetic carriers and when gaining stability at high levels.

While the volume average particle diameter of the toner is greater than the maximum of the range, it is hard to obtain high quality of image at high resolutions. In addition, reproductivity of neutral colors degrades in color images, the graininess of the toner is increased, and the quality of color images is lowered.

When the ratio Dv/Dn is more than 1.40, it is unfavorable because the distribution of the amount of charge is widen and the resolution power also lowers.

The average particle diameter and the particle size distribution of the toner can be measured by using, for example, Coulter Counter TA-II and Coulter Multi-sizer II (both manufactured by Beckman Coulter, Inc.). In the present invention, to measure the average particle diameter and the particle size distribution of the toner, Coulter Counter TA-II was used and connected to an interface (manufactured by The Institute of Japanese Union of Scientists & Engineers) and a personal computer PC9801 manufactured by NEC which outputs data on a number distribution and a volume distribution.

In the image forming apparatus of the present invention, it is preferred to use a toner having a shape factor SF-1 being 100 to 180 and a shape factor SF-2 being 100 to 180.

FIG. 1A is a view exemplarily showing a toner shape for explaining a toner shape factor SF-1.

Figure 1B:
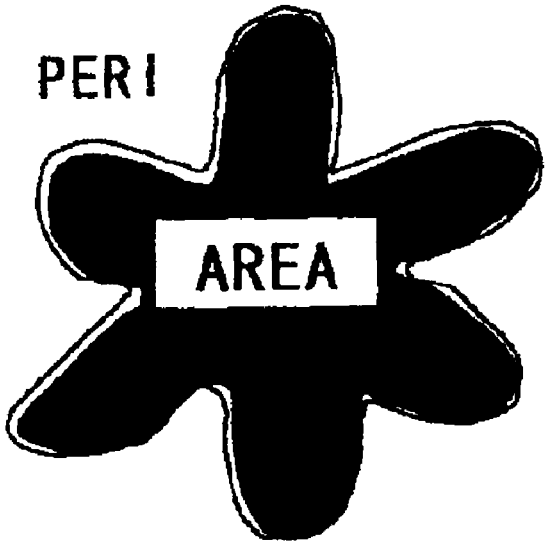
FIG. 1B is a schematic view exemplarily showing a toner shape for explaining a toner shape factor SF-2.

FIG. 1B is a schematic view exemplarily showing a toner shape for explaining a toner shape factor SF-2.

A substantially spherical shape of the toner of the present invention is represented by the shape factor SF-1, and the value of shape factor SF-1 is preferably 100 to 180.

The shape factor SF-1 represents a degree of roundness of the toner shape and is represented by the following Equation (1). It is a value that a squared-value of the maximum length (MXLNG) of the figure which can be formed by projecting a toner onto a two-dimensional plane is divided by the figure area (AREA) and then multiplied by 100π/4.

$$SF\text{-}1=[(MXLNG)^2/AREA]\times(100\pi/4) \quad \text{Equation (1)}$$

When the value of shape factor SF-1 is 100, the shape of the toner is a perfect sphere, and the greater the value of shape factor SF-1 is, the more indefinite the toner shape is. When the value of shape factor SF-1 is more than 180, cleaning ability is improved, however, the distribution of the amount of charge is wider, resulting in a large amount of ground fogging of toner and degraded quality of image, because the toner shape largely deviates from the definition. Since the developed image and transferred image through a magnetic field is not true to the line of electric force due to resistance of air of moving of toner particles, the toner is developed between thin lines, resulting in lowered image uniformity and lowered image quality. Particularly in reproduction of color images, there are many uneven color tones in halftone parts and solid parts, and the graininess increases, resulting in degraded color images. The value of shape factor SF-1 is preferably 110 to 150, and more preferably 115 to 145.

In the toner of the present invention, it is preferred that concaves and convexes or irregularities formed on the surface of the toner be represented by the shape factor SF-2, and the value of SF-2 be 100 to 180. The value of SF-2 represents a degree of concaves and convexes or irregularities of the toner shape and is represented by the following Equation (2). A value of the shape factor SF-2 is the one that a squared-value of a peripheral length (PERI) of the figure which can be formed by projecting a toner onto a two-dimensional plane is divided by the figure area (AREA) and then multiplied by 100/4%.

$$SF\text{-}2=[(PERI)^2/AREA\}\times(100/4\pi)] \quad \text{Expression (2)}$$

When the value of SF-2 is 100, concaves and convexes or irregularities are not easily present on the surface of the toner, and the greater the value of SF-2 is, the more conspicuous concaves and convexes on the toner surface are. When the value of SF-2 is more than 180, cleaning ability is improved, however, concaves and convexes or irregularities on the toner surface are greater, and the distribution of the amount of charge is wider, resulting in degraded image quality. In addition, in reproduction of color images, there are many uneven color tones in halftone parts and solid parts, and the graininess increases, resulting in degraded color images. When the value of SF-2 is 100 and the toner surface is smooth, cleaning of the toner is possible according to the blade cleaning method, and high quality images can be obtained because the toner has a narrow distribution of amount of charge. The value of SF-2 is preferably 110 to 150, and more preferably 115 to 145.

For the toner used in the present invention, it is possible to use polymerizable toners according to polymerization methods such as suspension polymerization, emulsion and dispersion polymerization, emulsion aggregation, and emulsion polymerization; and pulverized toners according to a dry-process melting and kneading method. As an example of producing a pulverized toner, it is possible to use a toner production method which comprises mechanically kneading components of a developer in which at least a binder resin, a primary charge controlling agent, and a colorant is included; dissolving and kneading the components; pulverizing the components; and classifying toner particles. To improve dispersibility of a colorant, the colorant may be mixed with other raw materials after preparation of masterbatch and then mixed in the next step. In the mixing, components of the developer in which at least a binder resin, a primary charge controlling agent, a colorant, and by-products may be mechanically mixed under normal conditions using a typical mixer with rotational blades, and the mixing method is not particularly limited. Upon completion of the mixing, the mixtures are poured into a kneader to dissolve and knead them.

For the kneader for dissolving the mixtures, single-screw or double-screw continuous kneaders and batch kneaders using roll mill can be used. For a specific unit for kneading the toner, preferred examples thereof include batch double rolls; banbary mixers; continuous double-screw extruders, for example, KTK type double-screw extruder manufactured by KOBE STEEL, LTD.; TEM type double-screw extruder manufactured by TOSHIBA MACHINE CO., LTD.; double-screw extruder manufactured by KCK Co., Ltd.; PCM type double-screw extruder manufactured by Ikegai Corp.; KEX type double-screw extruder manufactured by KURIMOTO, LTD.; and continuous type single-screw kneaders, for example, Co-kneader manufactured by Buss. The obtained molten kneaded mixture was cooled and then crushed. For example, the mixture was coarsely crushed using a hammer mill and Rotoplex Granulator Cutting Mill, and further a pulverizing mill using jet stream and a mechanical pulverizer can be used. Preferably, the mixture is pulverized so that the toner particles have an average particle diameter of 3 μm to 15 μm. Further, the particle size of the pulverized mixture is controlled to be 2.5 μm to 20 μm through the use of a wind-driven classifier or the like. Next, external additives are added to the toner particles. By mixing and agitating the toner particles and external additives using a mixer or the like, the external additives are coated on surfaces of the toner particles while being milled.

With the pulverized toner, releasing agents known in the art can be used for preventing fixing offsets. For the releasing agents, in particular, a free fatty acid carnauba wax, a montan wax, and an oxidized rice wax may be used alone or in combination with two or more from the perspective of improving dispersibility of releasing agents. Among them, carnauba waxes being microcrystalline and having an acid value of 5 or less, and montan waxes being microcrystalline and having an acid value of 5 to 14 are preferable. For other releasing agents, solid silicone varnishes, higher fatty acid higher alcohols, montan ester waxes, low molecular mass polypropylene waxes and the like can be used. Binder resins known in the art can also be used, and particularly, polyester resins are preferably used from the perspective of improving dispersibility of pigments and obtaining images in a wider color reproduction range. Further, by adding a hybrid resin components which comprises a vinyl-type polymerizable unit and a polyester-type unit as a binder resin, the hybrid resin components can exert effect as a dispersing agent and a releasing agent to the polyester component, and in a dry-type pulverized toner a releasing agent can minutely disperse to the polyester resin serving as a binder resin, because solubility between releasing agents and the vinyl-type polymerizable unit in the hybrid resin components is high, and solubility between the polyester resin in the binder resin and the polyester unit in the hybrid resin components is high. In addition, when raw materials are mixed in powder conditions in producing a toner, colorants such as carbon black or masterbatch colorants are more likely to adhere to a binder resin than to a releasing agent because of high adhesiveness of the releasing agent and are easily dispersed following the releasing agent. Therefore, dispersibility of releasing agents improves dispersibility of colorants. Further, since the vinyl-type polymerizable unit in the hybrid resin components is hydrophobic, it can lower hygroscopicity of toner, resulting in enhanced environmental charge stability of the toner. It also prevents acceleration of cohesiveness of the toner to be absorbed into the hybrid resin components. Thus, by using a polyester resin as a binder resin in a toner which comprises a releasing agent and by further using a hybrid resin in the toner, a toner having high color reproductivity can be yielded without substantially impairing glossiness of the toner because dispersibility of the releasing agent is excellent, flocculation of toner does not occur due to indispersiblity of a releasing agent, and dispersibility of pigments are improved without losing glossiness.

Further, a polyester resin serving as a binder resin which comprises a linear polyester without including components insoluble in tetrahydrofuran or THF and a nonlinear polyester including components insoluble in tetrahydrofuran or THF allows ensuring a much wider fixing temperature range. By adding a linear polyester and a nonlinear polyester, low-temperature fixing property can be improved by the linear polyester, and anti-hot-offset property can be improved by the nonlinear polyester, however, in order not to impair glossiness of toner, dispersibility of releasing agent must be improved. To improve dispersibility of releasing agent, typically, it can be improved by controlling shearing force and dispersibility mechanically when kneading toner materials, however, in actuality, it is difficult to separate shearing force and dispersibility completely to control them. When dispersibility is improved, shearing force is also improved in synchronization with the improved dispersibility. This moves ahead with low-molecular mass of toner particles to make it impossible to improve anti-hot offset property through the use of a nonlinear polyester. However, there is not much necessity to control mechanical energy to dispersibility, and a releasing agent may be controlled by only shearing force because dispersibility of releasing agents and colorants are improved by adding the hybrid resin. By adding a hybrid resin, it is possible to improve low-temperature fixing property with a linear polyester as well as to improve anti-hot offset property with a nonlinear polyester.

For the polymerizable toners, a toner is used in which a binder resin, a prepolymer of the binder resin, and a releasing agent are dissolved and dispersed as toner materials in an organic solvent, and the toner materials are further dispersed in an aqueous medium to emulsify and granulate toner particles.

Hereinafter, constituent materials of the toner and a preferable toner production method will be described.

-Polyester-

The polyester can be produced by polycondensation reaction between a polyvalent alcohol compound and a polyvalent carboxylic acid compound.

Examples of the polyvalent alcohol compound (PO) include a divalent alcohol (DIO) and a trivalent or more polyvalent alcohol (TO), and any of a divalent alcohol (DIO) alone and a mixture of a divalent alcohol (DIO) with a small amount of a polyvalent alcohol (TO) are preferable. Examples of the divalent alcohol (DIO) include alkylene glycols such as ethylene glycol, 1,2-propylene glycol, 1,3-propylene glycol, 1,4-bytandiol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bispheonol A, bisphenol F, and bisphenol S; alkylene oxide adducts of the above-noted alicyclic diols such as ethylene oxides, propylene oxides, and butylene oxides; and alkylene oxide adducts of the above-noted bisphenols such as an ethylene oxide, propylene oxides, and butylene oxides. Among the above mentioned, an alkylene glycol having carbon atoms 2 to 12 and an alkylene oxide adduct of bisphenols are preferable, and an alkylene oxide adduct of bisphenols and a combination of the adduct with an alkylene glycol having carbon atoms 2 to 12 are particularly preferable. Examples of the trivalent or more polyvalent alcohol (TO) include polyaliphatic alcohols of trivalent to octavalent or more such as glycerine, trimethylol ethane, trimethylol propane, pentaerythritol, and sorbitol; and trivalent or more phenols such as trisphenol PA, phenol novolac, and cresol novolac; and alkylene oxide adducts of the trivalent or more polyphenols.

Examples of the polyvalent carboxylic acid (PC) include a divalent carboxylic acid, i.e. DIC and a trivalent or more polyvalent carboxylic acid, i.e. TC, and any of a divalent carboxylic acid (DIC) alone and a mixture of a divalent carboxylic acid (DIC) with a small amount of a polyvalent carboxylic acid (TC) are preferable. Examples of the divalent carboxylic acid (DIC) include alkylene dicarboxylic acids such as succinic acids, adipic acids, and sebacic acids; alkenylen dicarboxylic acids such as maleic acids, and fumaric acids; aromatic dicarboxylic acids such as phthalic acids, isophthalic acids, terephthalic acids, and naphthalene dicarboxylic acids. Among these divalent carboxylic acids, an alkenylen dicarboxylic acid having carbon atoms 4 to 20 and an aromatic dicarboxylic acid having carbon atoms 8 to 20 are preferable. Examples of the trivalent or more polyvalent carboxylic acids (TC) include aromatic polyvalent carboxylic acid having carbon atoms 9 to 20 such as trimellitic acids, and pyromellitic acids. It is noted that as a polyvalent carboxylic acid (PC), an acid anhydride from among the polyvalent carboxylic acids or a lower alkyl esters such as methyl esters, ethyl esters, and isopropyl esters may be used to react to a polyvalent alcohol (PO).

A ratio of a polyvalent alcohol (PO) to a polyvalent carboxylic acid (PC), defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

In the polycondensation reaction between a polyvalent alcohol (PO) and a polyvalent carboxylic acid (PC), the polyvalent alcohol and the polyvalent carboxylic acid are heated at 150° C. to 280° C. in the presence of esterified catalysts known in the art such as tetrabutoxy titanate and dibutyltin oxide, and produced water is distilled away while reducing pressure in accordance with necessity to thereby yield a polyester having a hydroxyl group. The polyester preferably has a hydroxy group valence of 5 or more. The acid value of the polyester is preferably 1 to 30, and more preferably 5 to 20. By giving acid values to a polyester, it is easily negatively chargeable, and further low-temperature fixing property is improved when an image is fixed to a recording paper because of excellent affinity between recording paper and the toner. However, when the acid value of polyester is more than 30, it tends to negatively react to stability of charging, in particular, environmental changes.

The mass average molecular mass of the polyester is preferably 10,000 to 400,000, and more preferably 20,000 to 200,000. When the mass average molecular mass is less than 10,000, it is not preferable because anti-offset property degrades. When the mass average molecular mass is more than 400,000, it is not preferable because low-temperature fixing property degrades.

Preferably, in the polyester, a urea-modified polyester is included besides the unmodified-polyester which can be obtained by polycondensation reaction. The urea-modified polyester can be obtained as follows. Carboxyl group and hydroxyl group or the like at the end of a polyester obtained by the polycondensation reaction are reacted with a polyvalent isocyanate compound (PIC) to obtain a polyester prepolymer A having an isocyanate group. The polyester prepolymer A was reacted with amines, and molecular chains of the polyester are cross-linked and/or elongated to thereby yield a urea modified polyester.

Examples of the polyvalent isocyanate compound (PIC) include aliphatic polyvalent isocyanates such as tetramethylen diisocyanate, hexamethylen diisocyanate, and 2,6-diisocyanate methyl caproate; alicyclic polyisocyanates such as isophorone diisocyanate, and cyclohexyl methane diisocyanate; aromatic diisocyanate such as tolylene diisocyanate, and diphenylmethane diisocyanate; aromatic aliphatic diisocyanates such as $\alpha,\alpha,\alpha',\alpha'$-tetramethyl xylylene diisocyanate; isocyanates; compounds in which the above noted polyisocyanate is blocked with a phenol derivative, oximes, caprolactams; and combinations of two or more elements thereof.

The ratio of a polyvalent isocyanate compound (PIC), defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When the ratio [NCO]/[OH] is more than 5, low-temperature fixing properties degrade. When the molar ratio of [NCO] is less than 1 and a urea modified polyester is used, the urea content of ester lowers, resulting in degraded anti-hot-offset property.

The constituent content of polyvalent isocyanate compound (PIC) of a polyester prepolymer having an isocyanate group (A) is typically 0.5% by mass to 40% by mass, preferably 1% by mass to 30% by mass, and more preferably 2% by mass to 20% by mass. When the constituent content thereof is less than 0.5% by mass, anti-hot-offset property degrades and it may bring about disadvantages in balancing heat resistant storage properties with low-temperature fixing properties. On the other hand, when the constituent content thereof is more than 40% by mass, low-temperature fixing properties may degrade. The number of isocyanate groups contained in per one molecular of polyester prepolymer having isocyanate group (A) is typically 1 or more, preferably 1.5 to 3 on an average, and more preferably 1.8 to 2.5 on an average. When the number of isocyanate groups is less than 1 per 1 molecular of polyester prepolymer, the molecular mass of the urea modified polyester lowers, resulting in degraded anti-hot-offset property.

Next, examples of amines (B) to be reacted to a polyester prepolymer (A) include divalent amine compounds (B1), trivalent or more polyvalent amine compounds (B2), aminoalcohols (B3), amino mercaptans (B4), amino acids (B5), and compounds in which an amino group of B1 to B5 is blocked (B6).

Examples of the divalent amine compounds (B1) include aromatic diamines such as phenylene diamines, diethyl toluene diamines, 4,4'-diamino diphenyl methanes; alicyclic diamines such as 4,4'-diamino-3,3'-dimethyl dicyclohexyl methane, diamine cyclohexane, and isophorone diamine; and aliphatic diamines such as ethylene diamine, tetramethylene diamine, and hexamethylene diamine. Examples of the trivalent or more polyvalent amine compounds (B2) include diethylene triamine, and triethylene tetramine. Examples of the aminoalcohols (B3) include ethanol amines, and hydroxyethylanilines. Examples of the amino mercaptans (B4) include aminoethyl mercaptan, and aminopropyl mercaptan. Examples of the amino acids (B5) include aminopropionic acid, aminocaproic acid, and the like. Examples of the compounds in which an amino group of B1 to B5 is blocked (B6) include ketimine compounds obtained from the above-noted amines of B1 to B5 and ketones such as acetone, methyl ethyl ketone, and methyl isobuthyl ketone and oxazolidine compounds, and the like. Among these amines (B), divalent amine compounds B1 and mixtures of B1 with a small amount of a trivalent or more polyvalent amine compound (B2) are preferable.

The ratio of amines (B), defined as an equivalent ratio [NCO]/[NHx] of isocyanate group [NCO] in a polyester prepolymer having isocyanate group (A) to amine group [NHx] in amines (B), is typically 1/2 to 2/1, preferably 1.5/1 to 1/1.5, and more preferably 1.2/1 to 1/1.2. When [NCO]/[NHx] is more than 2 or less than ½, the molecular mass of urea modified polyester lowers, resulting in degraded anti-hot-offset property.

In addition, the urea modified polyester may include a urethane bond as well as a urea bond. A molar ratio of the urea bond content to the urethane bond content is typically 100/0 to 10/90, preferably 80/20 to 20/80, and more preferably 60/40 to 30/70. When a molar ratio of the urea bond is less than 10%, anti-hot-offset property degrades.

A toner binder may be produced by the one-shot method, and the like. Specifically, a polyvalent alcohol (PO) and a polyvalent carboxylic acid (PC) are heated to a temperature of 150° C. to 280° C. in the presence of an esterified catalyst known in the art such as a tetrabutoxy titanate, and a dibutyltin oxide, and yielded water is removed while depressurizing as needed to obtain a polyester having a hydroxyl group. Next, the obtained polyester is reacted to a polyisocyanate compound (PIC) at a temperature of 40° C. to 140° C. to obtain a polyester prepolymer having an isocyanate group (A). Further, the prepolymer (A) is reacted to amines (B) at a temperature of 0° C. to 140° C. to obtain a modified polyester with urea bond.

When reacting a polyisocyanate compound (PIC) and when reacting the polyester prepolymer (A) to amines (B), a solvent may be used in accordance with the necessity. Examples of available solvents include solvents which are inactive to polyisocyanate compounds (PIC) such as aromatic solvents such as toluene, and xylene; ketones such as acetone, methyl ethyl ketone, and methyl isobutyl ketone; esters such as ethyl acetate; amides such as dimethylformamide, and dimethylacetamide; and ethers such as tetrahydrofuran.

In accordance with the necessity, reaction stoppers may be used for cross-linkage and/or elongation reactions between polyester prepolymer (A) to amine (B) to control the molecular mass of the obtained urea-modified polyester. Examples of the reaction stoppers include monoamines such as diethylamines, dibutylamines, butylamines, laurilamines, and compounds with the reaction stoppers are blocked such as ketimine compounds.

The mass average molecular mass of the urea-modified polyester is typically 10,000 or more, preferably 20,000 to 10,000,000 and more preferably 30,000 to 1,000,000. The mass average molecular mass is less than 10,000, anti-hot-offset property may degrade.

The number average molecular mass of the urea-modified polyester when used together with an unmodified polyesteris not particularly limited, and it may be a number average molecular mass which is easily obtained to obtain the above-noted mass average molecular mass. When a urea-modified polyester is used alone, the number average molecular mass is typically 2,000 15,000, more preferably 2,000 to 10,000, and still more preferably 2,000 to 8,000. When the number average molecular mass is more than 20,000, low-temperature fixing properties and gloss properties when used in a full-color device may degrade.

Using an unmodified polyester in combination with a urea-modified polyester is preferable to the use of the modified polyester alone, because low-temperature fixing properties and gloss properties when used in a full-color device are improved. Besides, it may include polyester which is modified by a chemical bond other than urea bonds.

It is preferred that at least part of a urea-modified polyester be compatible with part of an unmodified polyester, from the aspect of low-temperature fixing properties and anti-hot-offset property. Thus, it is preferred that the composition of the urea-modified polyester be similar to that of the unmodified polyester.

The mass ratio of an unmodified polyester to a urea-modified polyester is typically 20/80 to 95/5, preferably 70/30 to 95/5, more preferably 75/25 to 95/5, and still more preferably 80/20 to 93/7. When the mass ratio of the urea-modified polyester is less than 5%, anti-hot-offset property degrades and it brings about disadvantages in balancing between heat resistant storage properties and low-temperature fixing properties.

The glass transition temperature (Tg) of the binder resin which comprises an unmodified polyester and a urea-modified polyester is preferably 45° C. to 65° C., and more preferably 45° C. to 60° C. When the glass transition temperature (Tg) is less than 45° C., heat resistance of the toner may degrade, and when more than 65° C., low-temperature fixing properties may be inadequate.

In addition, since urea-modified polyesters easily reside on surfaces of the toner base particles, they show a more favorable tendency in heat resistance even with low glass transition temperatures, compared to polyester toners known in the art.

-Releasing Agent-

The releasing agent is not particularly limited and may be suitably selected from those known in the art, however, from the perspective of improving dispersibility of the releasing agent, it is particularly preferred that removal flee fatty acid type carnauba wax, montan wax, and oxidized rice wax be used alone or in combination with two or more, of which carnauba wax being microcrystalline and having an acid value of 5 or less, and montan waxes being microcrystalline and having an acid value of 5 to 14 are preferable. For other releasing agents, solid silicone varnishes, higher fatty acid higher alcohols, montan ester waxes, low molecular mass polypropylene waxes and the like can be used.

-Colorant-

With respect to the colorants to be used, for magenta pigments, pigments represented by Structural Formula (1) are used, and for yellow pigments, pigments represented by at least any one of Structural Formula (2) and Structural Formula (3) are used. For cyan pigments, metal-free phthalocyanine blue, phthalocyanine blue, fast sky blue, indanthrene blue (RS, BC), indigo, ultramarine, iron blue, anthraquinon blue are used, of which phthalocyanine blue is particularly preferable. For the black toner, black pigments such as carbon black, furnace black, and magnetite are used.

The colorants may be used as a masterbatch which is compounded with a resin, and this is preferable for improving dispersibility of colorants and widening color reproduction ranges in images. Examples of the binder resin to be used in producing a masterbatch, or to be kneaded with a masterbatch include styrenes such as polystyrene, poly-p-chlorostyrene, polyvinyl toluene, and polymers of derivative substitutions thereof, or copolymers of the above-noted styrene and vinyl compounds, polymethyl methacrylate, polybutyl methacrylate, polyvinylchloride, polyvinyl acetate, polyethylene, polypropylene, polyester, epoxy resins, epoxy polyol resins, polyurethane, polyamide, polyvinyl butyral, polyacrylic acid resins, rodin, modified-rodin, terpene resins, aliphatic hydrocarbon resins, alicyclic hydrocarbon resins, aromatic petroleum resins, chlorinated paraffins, and paraffin waxes. Each of these colorants may be employed alone or in combination of two or more.

-Charge Controlling Agent-

As charge controlling agents, those in the art may be used. Examples of the charge controlling agents include nigrosine dyes, triphenylmethane dyes, chrome-contained metal-complex dyes, molybdic acid chelate pigments, rhodamine dyes, alkoxy amines, quaternary ammonium salts including fluoride-modified quaternary ammonium salts, alkylamides, phosphoric simple substance or compounds thereof, tungsten simple substance or compounds thereof, fluoride activators, salicylic acid metallic salts, and salicylic acid derivative metallic salts. Specifically, Bontron 03 being a nigrosine dye, Bontron P-51 being a quaternary ammonium salt, Bontron S-34 being a metal containing azo dye, Bontron E-82 being an oxynaphthoic acid metal complex, Bontron E-84 being a salicylic acid metal complex, and Bontron E-89 being a phenol condensate (manufactured by Orient Chemical Industries, Ltd.); TP-302 and TP-415 being a quaternary ammonium salt molybdenum metal complex (manufactured by HODOGAYA CHEMICAL CO., LTD.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (manufactured by Hoechst Ltd.); LRA-901, and LR-147 being a boron metal complex (manufactured by Japan Carlit Co., Ltd.), copper phtalocyamine, perylene, quinacridone, azo pigments, and other high-molecular mass compounds having a functional group such as a sulfonic acid group, a carboxyl group, and a quaternary ammonium salt. Among the charge controlling agents, a substance capable of controlling a toner to a negative polarity is preferably used.

The usage of the charge controlling agent is determined depending on the type of the binder resin, presence or absence of an additive to be used as required, and the method for producing a toner including a dispersion process and is not limited uniformly, however, to 100 parts by mass of binder resin, 0.1 parts by mass to 10 parts by mass of the charge controlling agent is preferably used and more preferably with 0.2 parts by mass to 5 parts by mass of the charge controlling agent. When the charge controlling agent is more than 10 parts by mass, toner's charge properties are exceedingly large, which lessens the effect of the charge controlling agent itself and increases in electrostatic attraction force with a developing roller, and causes degradations of fluidity and image density of developer.

The charge controlling agents and releasing agents may be dissolved and kneaded with the masterbatch and the binder resin and, of course, may be added when they are dissolved and dispersed in an organic solvent.

<Toner Production Method>

Next, the toner production method of the present invention will be described. A preferred example of the toner production method is described below, however, the present invention is not limited to the example.

1) A colorant, an unmodified polyester, a polyester prepolymer having an isocyanate group, and a releasing agent dispersed into an organic solvent to prepare a toner materials-contained solution.

As to the organic solvent, an organic solvent being volatile with a boiling point less than 100° C. is preferable in terms of ease of removability after toner base particles being formed. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone and the like may be used alone or in combination with two or more. Particularly, aromatic solvents such as toluene, xylene, and halogenated hydrocarbons such as methylene chloride, 1,2-dichloroethane, chloroform, carbon tetrachloride are preferable. The usage of the organic solvent to 100 parts by mass of the polyester prepolymer is preferably 0 part by mass to 300 parts by mass, more preferably 0 part by mass to 100 parts by mass, and still more preferably 25 parts by mass to 70 parts by mass.

2) The toner materials-contained solution is emulsified in an aqueous medium in the presence of a surface active agent and resin fine particles. The aqueous medium may be water alone or may comprise an organic solvent which comprises alcohols such as methanol, isopropyl alcohol, and ethylene glycol; dimethylformamide; tetrahydrofuran; and Cellosolves such as methyl cellosolve; and lower ketone such as acetone, and methyl ethyl ketone.

The amount of the aqueous medium for use is preferably 50 parts by mass to 2,000 parts by mass, and more preferably 100 parts by mass to 1,000 parts by mass relative to 100 parts by mass of the toner materials-contained solution. When the amount of aqueous medium is less than 50 parts by mass, the toner materials-contained solution may not be dispersed sufficiently, and the resulting toner particles may not have a predetermined average particle diameter. When it is more than 2,000 parts by mass, it is not unfavorable in terms of cost reduction.

Dispersing agents such as surface active agents and resin fine particles can be used arbitrarily for better particle size distribution and more stable dispersion in the aqueous medium.

Examples of the surface active agents include anionic surface active agents such as alkyl benzene sulphonates, α-olefin sulphonates, and phosphoric esters; amine salts cationic surface active agents such as alkylamine salts, amino alcohol fatty acid derivatives, polyamine fatty acid derivatives, and imidazoline; quaternary ammonium salts cationic surface active agents such as alkyltrimethylammonium salts, dialkyldimethylammonium salts, alkyldimethylbenzylammonium salts, pyridinium salts, alkylisoquinolium salts, and benzethonium chloride; nonionic surface active agents such as fatty acid amide derivatives, and polyhydric alcohol derivatives; and amphoteric surface active agents such as alanine, dedecyldi(aminoethyl)glycine, di(octylaminoethyl)glycine, N-alkyl-N,N-dimethylammonium betaine.

The effects of the surface active agents can be obtained in a small amount by using a surface active agent having a fluoroalkyl group. Preferred examples of anionic surface active agents having a fluoroalkyl group include fluoroalkyl carboxylic acids ($C_2$ to $C_{10}$) and metallic salts thereof, disodium perfluorooctanesulfonyl glutaminate, sodium 3-[(ω-fluoroalkyl ($C_6$ to $C_{11}$)oxy]-1-alkyl($C_3$ to $C_4$)sulfonate, sodium 3-[ω-fluoroalkanoyl ($C_6$ to $C_8$)—N-ethylamino]-1-propane sulfonate, fluoroalkyl ($C_{11}$ to $C_{20}$) carboxylic acids and metallic salts thereof, perfluoroalkyl carboxylic acids ($C_7$ to $C_{13}$), and metallic salts thereof, perfluoroalkyl ($C_4$ to $C_{12}$) sulfonic acids and metallic salts thereof, perfluorooctanesulfonic acid diethanolamide, N-propyl-N-(2-hydroxyethyl) perfluorooctanesulfonamide, perfluoroalkyl ($C_6$ to $C_{10}$) sulfonamide propyl trimethyl ammonium salts, perfluoroalkyl ($C_6$ to $C_{10}$)-N-ethylsulfonyl glycine salts, and monoperfluoroalkyl ($C_6$ to $C_{16}$) ethyl phosphoric esters.

Such fluoroalkyl-containing anionic surface active agents are commercially available under the trade names of, for example, Surflon S-111, S-112, and S-113 (manufactured by ASAHI GLASS CO., LTD.); Fluorad FC-93, FC-95, FC-98, and FC-129 (manufactured by Sumitomo 3M Ltd.); Unidyne DS-101, and DS-102 (manufactured by DAIKIN INDUSTRIES, LTD.); Megafac F-110, F-120, F-113, F-191, F-812, and F-833 (manufactured by Dainippon Ink & Chemicals, Inc.); ECTOP EF-102, 103, 104, 105, 112, 123A, 123B, 306A, 501, 201, and 204 (manufactured by Tohchem Products); and FTERGENT F-100 and F150 (manufactured by NEOS Co., Ltd).

Examples of fluoroalkyl-containing cationic surface active agents for use in the present invention include aliphatic primary, secondary and tertiary amic acids each having a fluoroalkyl group; aliphatic quaternary ammonium salts such as perfluoroalkyl having 6 to 10 carbon atoms sulfonamide propyltrimethyl ammonium salts; benzalkonium salts, benzethonium chloride, pyridinium salts, and imidazolium salts. Such fluoroalkyl-containing cationic surface active agents are commercially available, for example, under the trade names of Surflon S-121 (manufactured by ASAHI GLASS CO., LTD.); FLUORAD FC-135 (manufactured by Sumitomo 3M Ltd.); Unidyne DS-202 (manufactured by DAIKIN INDUSTRIES, LTD.); Megafac F-150, and F-824 (manufactured by Dainippon Ink & Chemicals, Inc.); ECTOP EF-132 (manufactured by Tohchem Products); and FTERGENT F-300 (manufactured by NEOS Co., Ltd).

For resin fine particles, the substances stated above may be used. Inorganic compounds such as tricalcium phosphate, calcium carbonate, titanium oxide, colloidal silica, and hydroxyl apatite can also be used as the dispersant.

For further stabilizing the primary particles in the dispersion, a polymeric protective colloid can be used as a dispersing agent in combination with any of the resin fine particles and inorganic compound dispersing agent. Examples of the polymeric protective colloid include homopolymers and copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; nitrogen-containing or heterocyclic compounds such as vinylpyridine, vinylpyrrolidone, vinylimidazole, and ethyleneimine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxymethyl cellulose, and hydroxypropyl cellulose.

The dispersing procedure is not particularly limited and includes known procedures such as low-speed shearing, high-speed shearing, dispersing by friction, high-pressure jetting, ultrasonic dispersion. To allow the dispersed particles to have an average particle diameter of 2 μm to 20 μm, the high-speed shearing procedure is preferably used. When a high-speed shearing dispersing machine is used, the number of rotation is not particularly limited and is preferably from 1,000 rpm to 30,000 rpm, and more preferably from 5,000 rpm to 20,000 rpm. The dispersion time is not particularly limited and is preferably from 0.1 minutes to 5 minutes in a batch system. The dispersing temperature is typically from 0° C. to 150° C. under pressures, and preferably from 40° C. to 98° C.

3) In parallel with preparation of the emulsified liquid, amines (B) are added to the emulsified liquid to be reacted with a polyester prepolymer having an isocyanate group (A).

The reaction is involved in cross-linking and/or elongation of molecular chains. The reaction time for cross-linking and/or elongation is appropriately set depending on the reactivity derived from the combination of the isocyanate structure of the polyester prepolymer (A) and the amines (B) and is typically from 10 minutes. to 40 hours, and preferably 2 hours to 24 hours. The reaction temperature is generally 0° C. to 150° C., and preferably 40° C. to 98° C. In accordance with the necessity, a catalyst known in the art may be used. Specifically, examples of the catalyst include dibutyltin laurates, and diocryltin laurates.

4) Upon completion of the reaction, the organic solvent is removed from the emulsified dispersion liquid, i.e. reactant and the residue is rinsed and dried to obtain toner base particles.

The entire system is gradually raised in temperature while stirring as a laminar flow, vigorously stirred at a constant temperature, and the organic solvent is removed to thereby yield toner base particles. When a substance that is soluble in acid or alkali such as calcium phosphate salts is used as a dispersion stabilizer, the dispersion stabilizer is removed from the fine particles by dissolving the dispersion stabilizer by action of an acid such as hydrochloric acid and washing the fine particles. Alternatively, the component can be removed, for example, by enzymatic decomposition.

After or before the rinsing and the removal of solvent, it is possible to provide a step that the emulsified dispersion liquid is left at a constant temperature for a given length of time to mature the produced toner particles. By carrying out this step, toner particles having predetermined particle diameters can be produced. The temperature of the emulsified dispersion liquid in the maturing step is preferably 25° C. to 50° C., and the time for maturing is preferably 10 minutes to 23 hours.

5) A charge-controlling agent is implanted into the obtained toner base particles, and then inorganic fine particles such as silica fine particles, and titanium oxide fine particles are added to the toner base particles as external additives and thereby yield a toner.

The implantation of a charge-controlling agent and the external addition of inorganic particles are performed according to conventional procedures using such as a mixer.

Thus, a toner having a small particle diameter with sharp particle size distribution can be easily obtained without substantial variation of particle size distribution. By applying strong agitation to the emulsified dispersion liquid in the step of removing the organic solvent, it is possible to control the toner shape from a perfect spherical shape to a spindle shape. In addition, surfaces of the toner base particles can be morphologically controlled within ranges from smooth surface to shriveled surface.

The toner of the present invention can be used as a tow-component developer by mixing it with carrier particles containing magnetic particles. In this case, the rate of content of the carrier particles to the toner in the developer is preferably 100 parts by mass of carrier particles to 1 part by mass to 10 parts by mass of the toner. For the magnetic carrier particles, magnetic carrier particles having a particle diameter of 20 μm to 200 μm, known in the art such as iron powder, ferrite powder, magnetite powder, and magnetic resin carrier may be used. Examples of coating materials of the toner include amino resins such as urea-formaldehyde resins, melamine resins, benzoguanamine resins, urea resins, polyamide resins, and epoxy resins. As the coating materials, it is also possible to use polyvinyl resins and polyvinylidene resins such as acrylic resins, polymethyl methacrylate resins, polyacrylonitrile resins, polyvinyl acetate resins, polyvinyl alcohol resins, and polyvinyl butyral resins; polystyrene resins such as polystyrene resins, and styrene-acryl copolymer resins; halogenated olefin resins such as polyvinyl chlorides; polyester resins such as polyethylene terephthalate resins, and polybutylene terephthalate resins; polycarbonate resins, polyethylene resins, polyvinyl fluoride resins, polyvinylidene fluoride resins, polytrifluoro ethylene resins, polyhexafluoro propylene resins, copolymers of vinylidene fluoride and acryl monomer, copolymers of vinylidene fluoride and vinyl fluoride; fluorotarpolymers such as tarpolymers of tetrafluoro ethylene and vinylidene fluoride and non-fluoride monomer; and a silicone resins, and the like. In addition, a conductive powder may be included in the coating resin material in accordance with the necessity. For the conductive powder, metal powder, carbon black, a titanium oxide, a tin oxide, a zinc oxide or the like can be used. The average particle diameter of these conductive powders is preferably 1 μm or less. When the average particle diameter is more than 1 μm, it is difficult to control electric resistivity.

In addition, the toner of the present invention can be used as a magnetic toner in which one-component developer is used with no use of carrier or a nonmagnetic toner.

In the image forming apparatus of the present invention, inorganic fine particles are preferably used as external additives for supplementing fluidity, developing property, and charge property of the toner. The primary particle diameter of the inorganic particles is preferably 5 nm to 2 μm. Further, to improve color reproductivity and cleaning ability, it is preferably to use inorganic particles having a primary particle diameter of 80 nm to 500 nm. The amount of inorganic fine particles to be added to the toner is preferably 0.01% by mass to 2.0% by mass. Specific examples of the inorganic particles include silicas, aluminas, titanium oxides, barium titanates, magnesium titanates, calcium titanates, strontium titanates, zinc oxides, tin oxides, silica sand, clay, mica, wallastonite, silious earth, chromium oxides, ceric oxides, colcothar, antimony trioxides, magnesium oxides, zirconium oxides, barium sulfates, barium carbonates, calcium carbonates, silicon carbides, and silicon nitrides. Besides the above-mentioned, polymer particles such as polymer particles such as polystyrene copolymers, methacrylic acid ester copolymers, and acrylic acid ester copolymers obtained by soap-free emulsion polymerization, suspension polymerization, and dispersion polymerization; and condensation polymers such as silicone, benzoguanamine, and nylon, and thermosetting resins.

Fluidizing agents as stated above enable preventing deteriorations of fluidity and charge properties of the toner even under high-humidity environment by performing surface treatment thereof to improve hydrophobic properties. Examples of preferable surface treatment agents include silane coupling agents, sililation reagents, silane coupling agents having a fluorinated alkyl group, organic titanate coupling agents, aluminum coupling agents, silicone oils, and modified silicone oils.

Besides, examples of cleaning ability improving agents for removing developer remaining on a photoconductor or a primary transferring medium after transferring include fatty acid metal slats such as zinc stearate, calcium stearate, and stearic acid; and polymer fine particles, for example, produced by a soap-free emulsion polymerization method such as polymethyl methacrylate fine particles, and polystyrene fine particles. Polymer fine particles preferably have a relatively narrow particle size distribution and a mass average particle diameter of 0.01 μm to 1 μm.

When preparing the external additive, the above-noted inorganic particles such as a hydrophobic silica fine particle powder, is further added to and mixed with the developer produced as stated above. A generally used mixer for powder is used in mixing external additives, however, a mixer equipped with a jacket or the like and capable of controlling the inside temperature thereof is preferable. To change history of load to be applied to the external additives, the external additives may be added in the course of mixing or by degrees. Of course, rotation speed of a mixer, rolling speed, mixing time, temperature, or the like may be altered. A heavy load may be given first, and then a relatively light load may be given to the mixer or may be conversely. Examples of usable mixing equipment include V-shaped mixer, rocking mixer, Ledige mixer, Nauter mixer, and HENSCHEL MIXER.

-Transferring and Transferring Unit-

The transferring is a step for transferring a visible image to a recording medium, and an aspect in which a visible image is primarily transferred onto an intermediate transfer member and then the visible image is secondary transferred to a recording medium is preferable. More preferably, an aspect of the transferring includes a primary transferring for primarily transferring a visible image onto an intermediate transfer member using two or more colors for the toner, preferably a full-color toner to form a complex transferred image and a secondary transferring for transferring the complex transferred image onto a recording medium.

The transfer of image can be carried out by charging the latent electrostatic image bearing member or photoconductor through the use of, for example, the above-noted charger for transferring a visible image and by means of the transferring unit. As the transferring unit, it is preferred utilize the aspect which includes a primary transferring unit for transferring a visible image onto an intermediate transfer member to form a complex transferred image; and a secondary transferring unit for transferring the complex transferred image onto the recording medium.

The intermediate transfer member is not particularly limited and may be selected from those known in the art in accordance with the intended use. Preferred examples of the intermediate transfer member include an image-transfer belt.

With respect to the transferring unit, i.e. the primary transferring unit and the secondary transferring unit, it is preferable to include at least a transfer device for separating the visible image formed on the latent electrostatic image bearing member or photoconductor to be charged onto the recording medium side. The transferring unit may include a single unit or two or more units.

Examples of the transcriber include a corona transcriber utilizing corona discharge, transcription belt, a transcription roller, a pressure transcription roller, and an adhesion transcriber.

And, the recording medium is not particularly limited and may is be suitably selected from recording media or recording paper known in the art.

The fixing is a step for fixing a visible image transferred onto a recording medium by using an image fixing apparatus, and the fixing may be performed every time each individual color toners is transferred onto the recording medium or at a time in the condition where each individual color toners has been superimposed.

The image fixing apparatus is not particularly limited and may be selected in accordance with the intended use, however, a heat pressure unit known in the art is preferable. Examples of the heat pressure unit include a combination of a heat roller and a pressure roller, and a combination of a heat roller, pressure roller and an endless belt.

Preferably, the image fixing apparatus is fixing unit which comprises a heater equipped with a heating element, a film making contact with the heater, a pressurizing member which is pressed to and is contacting the heater through the film, in which a recording medium with an unfixed image formed thereon is passed through between the film and the pressurizing member to heat and fix the image on the recording medium.

The heating temperature in the heat pressure unit is preferably 80° C. to 200° C.

In the present invention, for example, an optical fixing apparatus known in the art may be used together with the fixing and the fixing unit or instead of them, in accordance with the intended use.

The charge-eliminating is a step for eliminating electricity by applying charge-eliminating bias to the latent electrostatic image bearing member, and it can be suitably performed by means of a charge-eliminating unit.

The charge-eliminating unit is not particularly limited and may be required only to have the ability for applying charge-eliminating bias to the latent electrostatic image bearing member, and this can be suitably performed by a charge-eliminating unit. The charge-eliminating unit can be selected from electricity eliminators known in the art. For example, a charge-eliminating lamp is suitable.

The cleaning is a step for removing electrographic toner residues remaining on the latent electrostatic image bearing member, and this can be suitably performed by means of a cleaning unit.

The cleaning unit is not particularly limited, and the unit is required only to have the ability for removing the electrophotographic toner residues remaining on the latent electrostatic image bearing member and may be suitably selected from cleaners known in the art such as a magnetic brush cleaner, an electrostatic brush cleaner, a magnetic roller cleaner, a blade cleaner, a brush cleaner, and a web cleaner.

The recycling is a step for recycling the electrophotographic color toner eliminated in the cleaning to the developing unit and can be carried out by means of a recycling unit.

The recycling unit is not particularly limited, and preferred examples thereof include carrying units known in the art.

The controlling is a step for controlling the above-noted individual steps, and this can be suitably performed by a controlling unit.

The controlling unit is not particularly limited and may be suitably selected in accordance with the intended use, provided that the movements of the above noted individual steps can be controlled. Examples of the controlling unit include instruments such as sequencers, and computers.

Hereinafter, an aspect of performing the image forming method according to the present invention through the use of the image forming apparatus of the present invention will be illustrated with reference to FIG. 2. The image forming apparatus 100 shown in FIG. 2 comprises photoconductor drum 10, hereinafter briefly referred to as photoconductor 10, as the latent electrostatic image bearing member, charge roller 20 as the charging unit, exposer 30 as the exposing unit, image developing apparatus 40 as the developing unit, intermediate transfer member 50, cleaner 60 serving as the cleaning unit with a cleaning blade provided therein, and charge-eliminating lamp 70 as the charge-eliminating unit.

Figure 2:
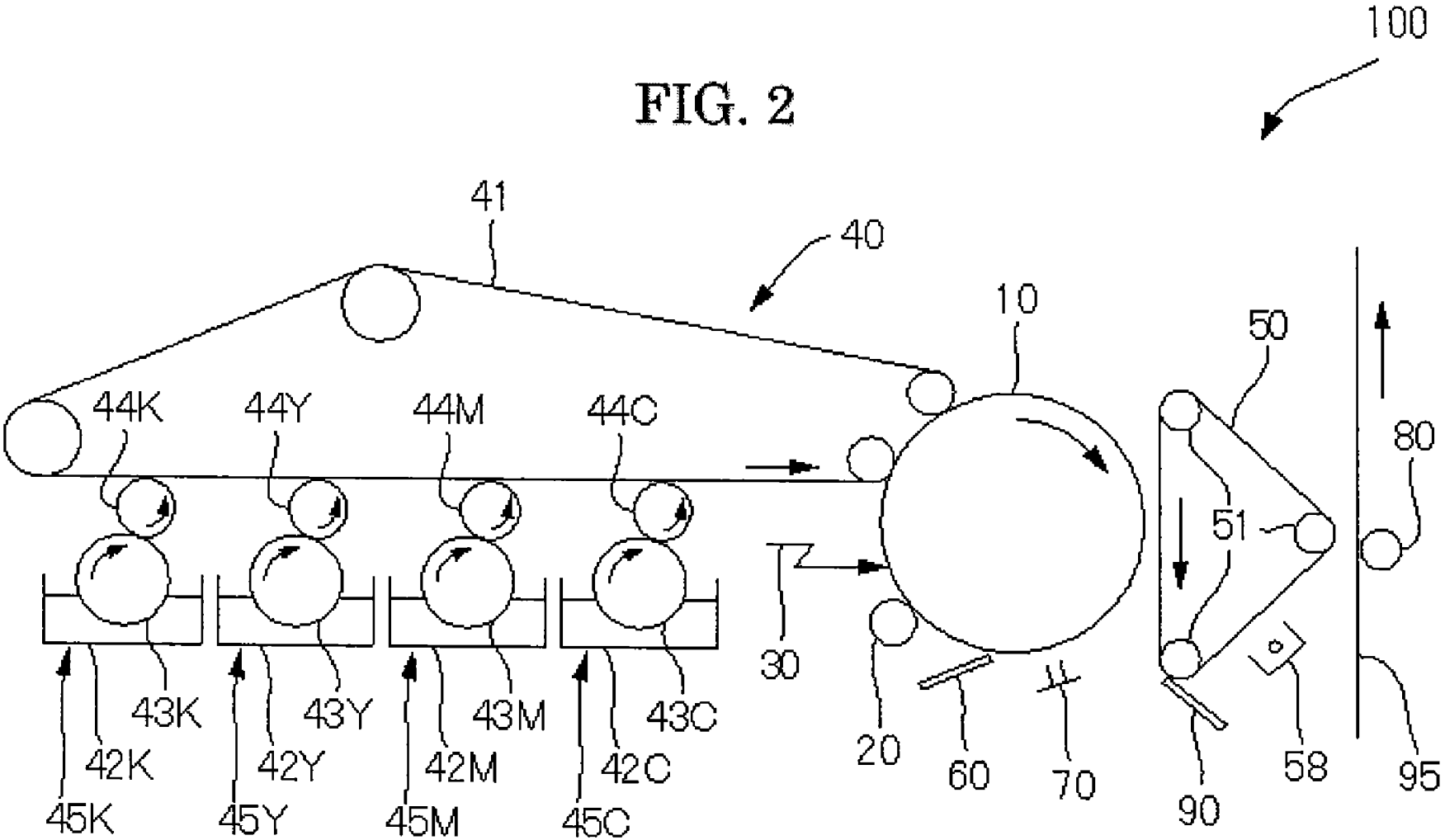
FIG. 2 is a schematic view exemplarily showing an example of performing an image forming method according to the present invention using an image forming apparatus of the present invention.

The intermediate transfer member 50 is an endless belt, and designed such that the intermediate transfer member is spanned over three rollers 51 disposed inside thereof and driven in the direction indicated by the arrow shown in FIG. 2. One of the three rollers 51 also serves as a bias roller capable of applying a given bias for image transfer, i.e. primary transfer bias to the intermediate transfer member 50. Cleaner 90 having a cleaning blade for cleaning the intermediate transfer member 50 is arranged in the vicinity of the intermediate transfer member 50. Transferring roller 80 as the transferring unit faces transferring sheet 95 and is capable of applying a bias for image transfer for transferring or secondary transferring of a developed image, i.e. toner image to transferring sheet 95 serving as a final transferring member. Corona charger 58 for applying charges onto the developed image on the intermediate transfer member 50 is arranged around the intermediate transfer member 50. The corona charger 58 is disposed between a contact area of the photoconductor 10 and the intermediate transfer member 50 and another contact area of the intermediate transfer member 50 and the transferring sheet 95 in the direction of rotation of the intermediate transfer member 50.

The image developing apparatus 40 comprises developing belt 41 as a developer bearing member, and black developing unit 45K, yellow developing unit 45Y, magenta developing unit 45M, and cyan developing unit 45C disposed around the developing belt 41. The black developing unit 45K includes developer container 42K, developer feed roller 43K, and developing roller 44K. The yellow developing unit 45Y includes developer container 42Y, developing feed roller 43Y, and developing roller 44Y. The magenta developing unit 45M includes developer container 42M, developer feed roller 43M, and developing roller 44M. The cyan developing unit 45C includes developer container 42C, developer feed roller 43C, and developing roller 44C. The developing belt 41 is formed in an endless belt and is rotatably spanned over plural belt rollers, a part of which is in contact with the photoconductor 10.

In the image forming apparatus shown in FIG. 2, for example, the charge roller 20 uniformly charges the photoconductor drum 10.

The exposer 30 exposes the photoconductor 10 imagewise to form a latent electrostatic image thereon. The image developing apparatus 40 feeds the toner to the photoconductor 10 to develop the latent electrostatic image thereon to thereby form a visible image, i.e. toner image. The visible image, i.e. toner image is transferred to the intermediate transfer member (primary transferring) and then transferred to the transferring sheet 95 (secondary transferring) by action of a voltage applied by the rollers 51, to thereby form a transferred image on the transferring sheet 95. Residual toner remaining on the photoconductor 10 after the transferring is removed by the cleaner 60, followed by elimination of residual charges on the photoconductor 10 by the charge-eliminating lamp 70.

Figure 3:
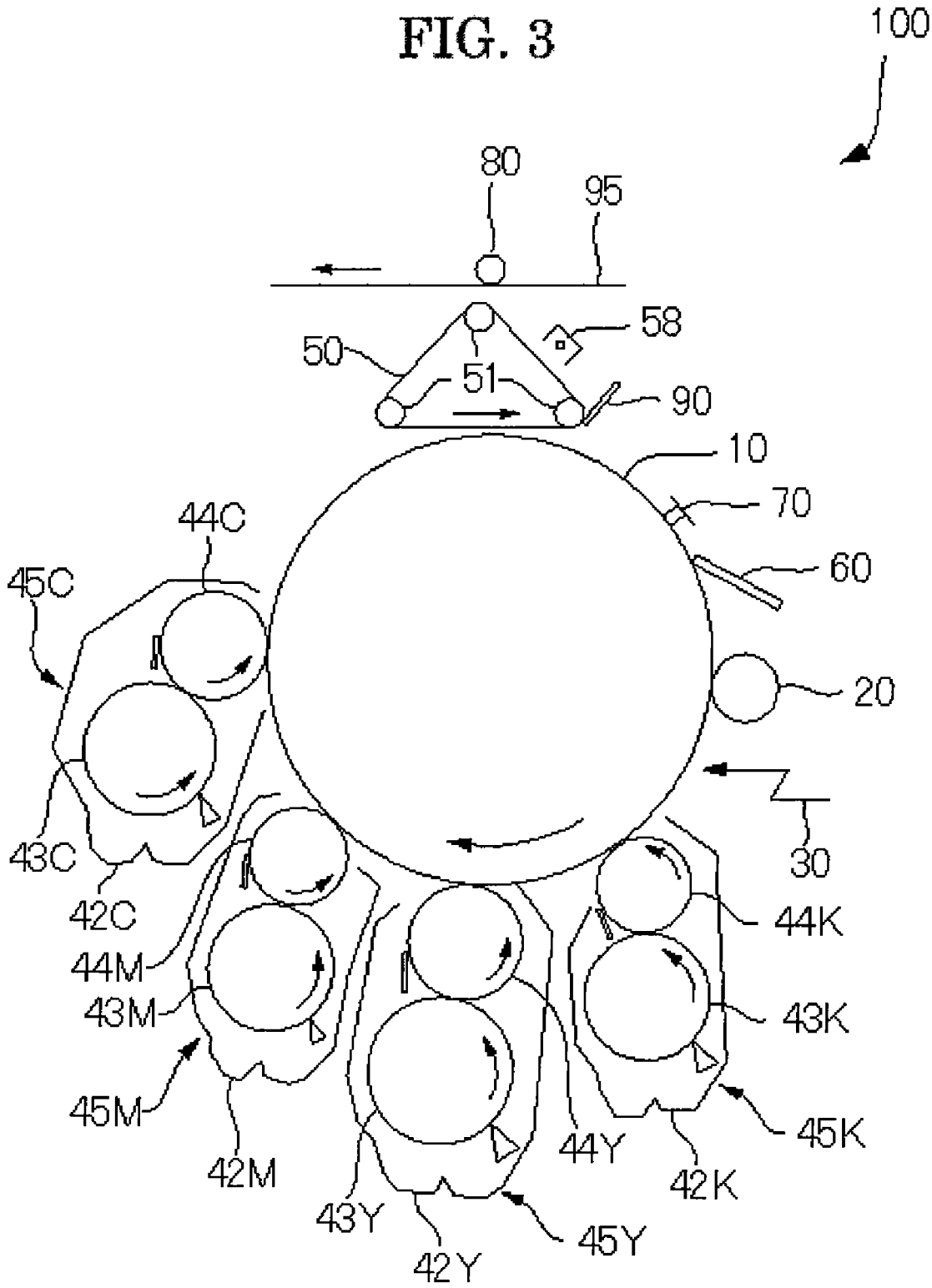
FIG. 3 is a schematic view exemplarily showing another example of performing an image forming method according to the present invention using an image forming apparatus of the present invention.

Another aspect of the image forming method using the image forming apparatus will be illustrated with reference to FIG. 3. The image forming apparatus 100 shown in FIG. 3 has the same configurations and the same advantages as in the image forming apparatus 100 shown in FIG. 2 except that the image forming apparatus 100 in FIG. 3 does not include developing belt 41 and that the black developing unit 45K, the yellow developing unit 45Y, the magenta developing unit 45M, and the cyan developing unit 45C surround and face the photoconductor 10. The components shown in FIG. 3 have the same reference numerals as those shown in FIG. 2, respectively.

Another aspect of the image forming method using the image forming apparatus of the present invention will be illustrated with reference to FIG. 4. Tandem image forming apparatus 120 shown in FIG. 4 is a tandem color image forming apparatus which comprises copier main body 150, sheet feeder table 200, scanner 300, and automatic document feeder (ADF) 400.

The copier main body 150 includes endless belt intermediate transfer member 50 at its center part. The intermediate transfer member 50 is spanned over three support rollers 14, 15, and 16 and is capable of rotating and moving in a clockwise direction in FIG. 4. Intermediate image-transfer member cleaner 17 is capable of removing residual toner from the intermediate transfer member 50 after image transfer and is arranged in the vicinity of the support roller 15. Above the intermediate transfer member 50 spanned between the support rollers of 14 and 15, yellow, cyan, magenta, and black image forming devices 18, namely four image forming devices are arrayed in parallel in a moving direction of the intermediate transfer member 50 to thereby constitute the tandem image forming apparatus 120. An exposer 21 is arranged in the vicinity of the tandem image forming apparatus 120. Secondary image transferer 22 faces the tandem image forming apparatus 120 with the interposition of the intermediate transfer member 50. The secondary image transferer 22 comprises an endless belt serving as secondary transferring belt 24 spanned over a pair of rollers 23. The transferring sheet transported in the vicinity of the secondary transferring belt 24 is capable of being in contact with the intermediate transfer member 50. Image fixing apparatus 25 is arranged on the side of the secondary image-transferer 22. The image fixing apparatus 25 comprises an endless belt serving as fixing belt 26 and pressure roller 27 arranged to be pressed by the fixing belt 26.

In the tandem image forming apparatus 120, sheet reverser 28 is arranged in the vicinity of the secondary image-transferer 22 and the image fixing apparatus 25. The sheet reverser 28 is capable of reversing the transferring sheet so as to form images on both sides of the transferring sheet.

Figure 4:
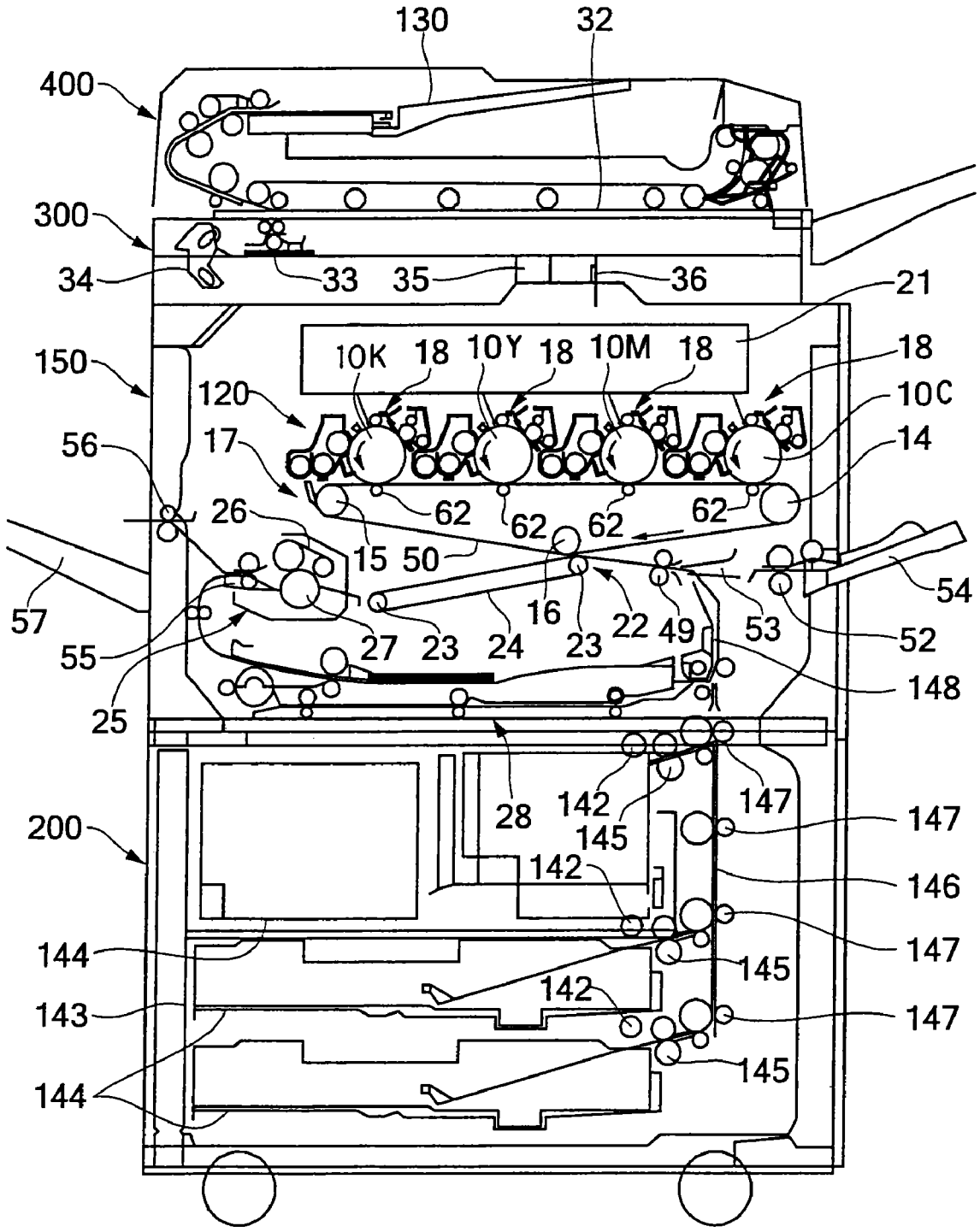
FIG. 4 is a schematic view exemplarily showing an example of performing an image forming method according to the present invention using a tandem color image forming apparatus of the present invention.

The tandem image forming apparatus 120 comprises black toner, yellow toner, magenta toner, and cyan toner in this order viewed from the left side of FIG. 4. Thus, when a full-color image is formed, black toner, yellow toner, magenta toner, and cyan toner are formed on the intermediate image transfer belt in this order. Black toner has effect of backing up and enhancing quality of full-color images by edging. However, when an image is transferred to a transferred sheet in secondary transferring, layers of cyan toner, magenta toner, yellow toner, and black toner are formed in this order on the transferred sheet, because the transferring sheet is reversed. With such configurations, a layer of the yellow toner is formed on the magenta toner.

The image developing apparatus may be a process cartridge configured to be supported with a photoconductor in a single body and be formed detachably to the main body of the image forming apparatus. This process cartridge may be configured to include a charging unit and a cleaning unit besides the above. With the above configurations, it is possible to improve exchangeability of components and convenience and to facilitate maintenance of the image forming apparatus.

Hereinafter, the way a full-color image, i.e. color copy is formed by using the tandem image forming apparatus 120 will be described. Initially, a document is placed on document platen 130 of the automatic document feeder (ADF) 400. Alternatively, the automatic document feeder (ADF) 400 is opened, a document is placed on contact glass 32 of the scanner 300, and the automatic document feeder (ADF) 400 is closed to press the document.

When pushing a starting switch (not shown), the document placed on the automatic document feeder 400 is transported onto the contact glass 32. When the document is initially place on the contact glass 32, the scanner 300 is immediately driven to operate first carriage 33 and second carriage 34. Light is applied from a light source to the document by action of the first carriage 33, and reflected secondary light from the document is further reflected toward the second carriage 34. The reflected light is further reflected by a mirror of the second carriage 34 and passes through image-forming lens 35 into read sensor 36 to thereby read the color document, i.e. color image and to produce black, yellow, magenta, and cyan image information.

Figure 5:
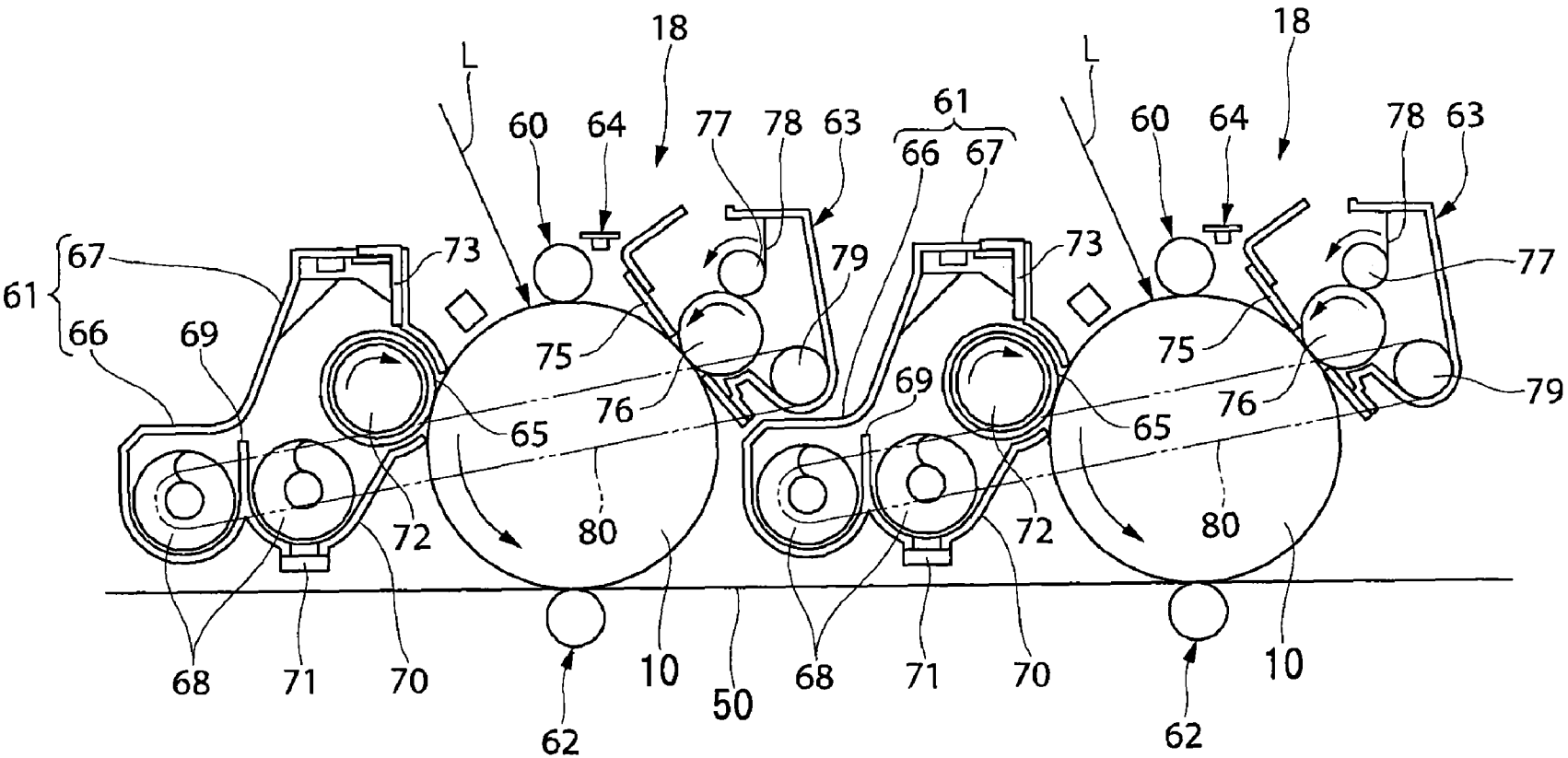
FIG. 5 is a partially enlarged schematic view of the image forming apparatus shown in FIG. 4.

Each of the black, yellow, magenta, and cyan image information is transmitted to each of the image forming devices 18, i.e. black, yellow, magenta, and cyan image forming devices in the tandem image forming apparatus 120 to thereby form black, yellow, magenta, and cyan toner image therein. Specifically, each of the image forming devices 18, i.e. black, yellow, magenta, and cyan image forming devices in the tandem image forming apparatus 120 comprises, as shown in FIG. 5, photoconductors 10, i.e. black photoconductor 10K, yellow photoconductor 10Y, magenta photoconductor 10M, and cyan photoconductor 10C; electrostatic charger 60 configured to charge the photoconductor evenly; an exposer configured to expose the photoconductor image wisely corresponding to each color image based on each color image information, which is represented by L in FIG. 5, to form a latent electrostatic image corresponding to each color images on the photoconductor; image developing apparatus 61 configured to develop the latent electrostatic image using each color toners, i.e. black toner, yellow toner, magenta toner, and cyan toner to form a toner image which comprises each of these color toners; transferring charger 62 for transferring the toner image onto the intermediate transfer member 50; cleaner 63 for cleaning the photoconductor, and charge-eliminator 64 to thereby respectively form a monochrome image, i.e. a black image, a yellow image, a magenta image, and a cyan image based on the respective color image information. The black image, the yellow image, the magenta image, and the cyan image formed as above, i.e. the black image formed on the black photoconductor 10K, the yellow image formed on the yellow photoconductor 10Y, the magenta image formed on the magenta photoconductor 10M, and the cyan image formed on the cyan photoconductor 10C are sequentially transferred (primary transferring) onto the intermediate transfer member 50 which is rotated and shifted by the support rollers 14, 15, and 16. Then, the black image, the yellow image, the magenta image, and the cyan image are superimposed on the intermediate transfer member 50 to thereby form a composite color image, i.e. transferred color image.

One of feeder rollers 142 of the feeder table 200 is selectively rotated, sheets or recording papers are ejected from one of multiple feeder cassettes 144 in paper bank 143 and are separated by separation roller 145 one by one into feeder path 146, and are transported by transport roller 147 into feeder path 148 in the copier main body 150 and are bumped against resist roller 49 and stopped. Alternatively, feeder roller 142 is rotated to eject sheets or recording papers on manual bypass tray 54, the sheets are separated one by one by separation roller 52 into manual bypass feeder path 53 and are bumped against the resist roller 49 and stopped. The resist roller 49 is generally grounded, however, may be used under the application of a bias to remove paper dust of sheets.

The resist roller 49 is rotated in synchronization with the movement of the composite color image, i.e. transferred color image on the intermediate transfer member 50 to transport the sheet or recording paper into between the intermediate transfer member 50 and the secondary image-transferer 22, and the composite color image, i.e. transferred color image is transferred onto the sheet by action of the secondary image-transferer 22 (secondary transferring) to thereby transfer the color image to the sheet or recording paper. Separately, the intermediate transfer member cleaner 17 removes residual toner remaining on the intermediate transfer member 50 after image transfer.

The sheet or recording paper bearing the transferred color image is transported by the secondary image-transferer 22 into the image fixing apparatus 25, is applied with heat and pressure in the image fixing apparatus 25 to fix the composite color image, i.e. transferred color image on the sheet or recording paper. The sheet then changes its direction by action of switch blade 55 and ejected by ejecting roller 56 to be stacked on output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 and then stacked onto the output tray 57.

According to the image forming apparatus and the image forming method of the present invention, color reproduction ranges of yellow and magenta can be widen, and the color reproduction range of neutral red colors can be widen. Further, it is possible to reduce toner scattering of magenta toner and yellow toner in the image forming apparatus and form high quality images.

EXAMPLES

Hereinafter, the present invention will be described referring to specific examples; however, the present invention is not limited to the disclosed examples. It is also noted that parts or part described below means parts by mass or part by mass, and % means % by mass.

Example 1

An example of a toner produced by polymerization will be described.

<Synthesis of Particulate Emulsion of Resin>

To a reaction vessel provided with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 80 parts of styrene, 83 parts of methacrylic acid, 110 parts of butyl acrylate, 12 parts of butyl thioglycollate, and 1 part of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion liquid of a vinyl resin or copolymer of styrene-methacrylic acid-butyl acrylate-sodium salt of the sulfuric acid ester of methacrylic acid ethylene oxide adduct. This aqueous solution was taken as particulate dispersion liquid.

The volume average particle diameter of the particulate dispersion liquid measured by a laser diffraction particle size distribution analyzer (LA-920, manufactured by SHIMADZU Corp.) was 120 nm. After drying part of particulate dispersion liquid and isolating the resin, the glass transition temperature (Tg) of the resin was 42° C., and the mass average molecular mass was 30,000.

<Preparation of Aqueous Phase>

To 990 parts of water, 65 parts of particulate dispersion liquid, 37 parts of a 48.5% aqueous solution of sodium dodecyl diphenylether disulfonic acid (ELEMINOL MON-7, manufactured by Sanyo Chemical Industries, Ltd.) and 90 parts of ethyl acetate were mixed and stirred together to obtain a milky liquid. This was taken as aqueous phase.

<Synthesis of Low Molecular Mass Polyester>

In a reaction vessel equipped with a condenser tube, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under normal pressure at 230° C. for 8 hours, and the reaction was further performed under reduced pressures of 10 mmHg to 15 mmHg for 5 hours, then 44 parts of anhydrous trimellitic acid was placed to the reaction vessel, and the reaction was performed at 180° C. under normal pressure for 2 hours to obtain a polyester. This polyester was taken as low molecular mass polyester. Low molecular mass polyester had a number average molecular mass (Mn) of 2,500, a mass average molecular mass (Mw) of 6,700, a glass transition temperature (Tg) of 43° C. and an acid value of 25.

<Synthesis of Intermediate Polyester>

In a reaction vessel equipped with a condenser tube, a stirrer, and a nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid, and 2 parts of dibutyl tin oxide were placed, and the reaction was performed under normal pressure at 230° C. for 8 hours, and then the reaction was further performed under reduced pressures of 10 mmHg to 15 mmHg for 5 hours to obtain an intermediate polyester. The intermediate polyester had a number average molecular mass (Mn) of 2,100, a mass average molecular mass (Mw) of 9,500, a glass transition temperature (Tg) of 55° C., an acid value of 0.5 and a hydroxyl group value of 51.

Next, 410 parts of the intermediate polyester, 89 parts of isophorone diisocyanate, and 500 parts of ethyl acetate were placed in a reaction vessel equipped with a condenser tube, a stirrer, and a nitrogen inlet tube, and the reaction was performed at 100° C. for 5 hours to obtain a prepolymer having an isocyanate group. The free isocyanate % by mass of the prepolymer was 1.53%.

-Synthesis of Ketimine-

Into a reaction vessel equipped with a stirrer and a thermometer, 170 parts of isophorone diamine and 75 parts of methyl ethyl ketone were poured, and the reaction was performed at 50° C. for 5 hours to obtain a ketimine compound. The amine value of the ketimine compound was 418.

-Synthesis of Masterbatch-

To 1200 parts of water, 40 parts of carbon black (Legal 400R, manufactured by Cabot Corporation) and 60 parts of polyester resin (RS801, manufactured by Sanyo Chemical Industries, Ltd.) were added, 30 parts of water were further added and mixed in HENSCHEL MIXER (manufactured by MITSUI MINING CO., LTD.) then the mixture was kneaded at 150° C. for 30 minutes using two rollers, extrusion cooled and crushed with a pulverizer to obtain masterbatch K.

Masterbatch M was produced in the same manner as above, provided that the carbon black was replaced by 50 parts of magenta pigment C.I pigment red 269.

Masterbatch Y was produced in the same manner as above, provided that the carbon black was replaced by 50 parts of yellow pigment C.I pigment yellow 155.

Masterbatch C was produced in the same manner as above, provided that the carbon black was replaced by 50 parts of cyan pigment C.I pigment blue 15:3.

-Preparation of Oil Phase-

Into a vessel equipped with a stirrer and thermometer, 400 parts of low molecular mass polyester, 110 parts of carnauba wax, and 947 parts of ethyl acetate were poured, and the temperature was raised to 80° C. with stirring, maintained at 80° C. for 5 hours and cooled to 30° C. in 1 hour. Next, 500 parts of the masterbatch K and 500 parts of ethyl acetate were poured into the vessel and mixed for 1 hour to obtain an initial material solution.

To a vessel, 1,324 parts of the initial material solution were transferred, and the wax were dispersed 3 times using a bead mill (Ultra Visco Mill, manufactured by AIMEX CO., LTD.) under the conditions of liquid feed rate 1 kg/h, disk circumferential speed of 6 m/s, 0.5 mm zirconia beads packed to 80% by volume. Next, 1324 parts of 65% ethyl acetate solution of the low molecular mass polyester was added and dispersed once by the bead mill under the above-noted conditions to obtain pigment K and wax dispersion liquid. The solids concentration of the pigment K and wax dispersion liquid heated at a temperature of 130° C. for 30 minutes was 50%. Similarly, the masterbatch M, the masterbatch Y, and the masterbatch C were also treated in the same manner as the masterbatch K to prepare pigment M and wax dispersion liquid, pigment Y and wax dispersion liquid, and pigment C and wax dispersion liquid.

-Emulsification-

In a vessel, 648 parts of each of the pigment and wax dispersion liquids K, M, Y, and C, 154 parts of prepolymer, 8.5 parts of the ketimine compound, and 1.0 part of a tertiary amine compound represented by the following Structural Formula (4) were respectively placed and mixed at 5,000 rpm for 1 minute by a TK homomixer (manufactured by TOKUSHU KIKA KOGYO CO., LTD.), then 1,200 parts of the aqueous phase were added to the vessel and mixed in the TK homomixer at a rotation speed of 10,000 rpm for 20 minutes to obtain an emulsion slurry. With this procedure, the dispersion of oil phase in the aqueous medium containing resin particulates and elongation reaction is performed.

Structural Formula 4

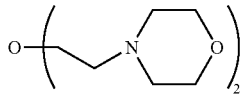

<Solvent Removal>

Each of the emulsion slurries K, M, Y, and C was placed in a vessel equipped with a stirrer and a thermometer, then the solvent was removed at 30° C. for 8 hours and the product was matured at 45° C. for 4 hours to obtain each of dispersion slurries K, M, Y, and C.

-Rinsing and Drying-

After filtering 100 parts of the obtained each of the dispersion slurries under reduced pressure, rinsing and drying of the filter cake were performed as follows:

(1) 100 parts of ion exchange water were added to the filter cake, mixed in a TK homomixer at a rotation speed of 12,000 rpm for 10 minutes and filtered.

(2) 100 parts of 10% sodium hydroxide were added to the filter cake of (1), mixed in a TK homomixer at a rotation speed of 12,000 rpm for 30 minutes and filtered.

(3) 100 parts of 10% hydrochloric acid were added to the filter cake of (2), mixed in a TK homomixer at a rotation speed of 12,000 rpm for 10 minutes and filtered.

(4) 300 parts of ion exchange water were added to the filter cake of (3), mixed in a TK homomixer at a rotation speed of 12,000 rpm for 10 minutes and filtered twice to obtain a filter cake. This was taken as Filter Cake.

The Filter Cake was dried in a circulating air dryer at 45° C. for 48 hours and then sieved through a sieve of 75 μm mesh to obtain toner base particles K, M, Y, and C, respectively.

With the above prescription, each of toner particles of black, magenta, yellow, and cyan having a volume average particle diameter of 6.6 μm were obtained. Next, to 100 parts of toner particles, 3.0 parts of colloidal silica (H-2000, manufactured by Clariant Japan K.K.) were added and mixed in Sample Mill to obtain a toner according to Example 1.

Each toner prepared in Example 1 and acrylic resin coat carrier particles having an average particle diameter of 32 μm were respectively mixed at a toner density of 8% to produce a developer.

Example 2

Next, an example of a toner produced by kneading and pulverizing will be described.

<Example of Production of Hybrid Resin HB (1)>

In a dropping funnel, 15 mol of styrene as an addition polymerization reactive monomer, 5 mol of butyl methacrylate, and 0.2 mol of t-butylhydro-peroxide as a polymerization initiator were placed. To a flask equipped with a stainless stirrer, a flow-down condenser, a nitrogen inlet tube, and a thermometer, 15 mol of fumaric acid as a monomer reactive to both addition polymerization and polycondensation, 5 mol of anhydrous trimellitic acid as a polycondensation reactive monomer, 5 mol of bisphenol A (2, 2) propylene oxide, 4 mol of bisphenol A (2, 2) ethylene oxide, and 6 mol of dibutyl tin oxide as an esterified catalyst were poured and stirred in an atmosphere of nitrogen at 135° C. while fall in drops of the preliminarily prepared mixture of the raw materials for addition polymerization reaction from the dropping funnel in 5 hours. After the dropping, the droplet was matured for 6 hours while keeping the temperature at 130° C., and then the temperature was raised to 220° C. and reacted to thereby obtain hybrid resin HB (1).

The obtained hybrid resin HB (1) did not contain tetrahydrofuran insoluble components, and had an acid value of 30, hydroxyl group value of 40, a glass transition temperature (Tg) of 58° C., a melting point of 110° C., a number average molecular mass (Mn) of 8,000, a mass average molecular mass (Mw) of 29,000, and peak top molecular mass of 7,500.

<Production of Nonlinear Polyester Resin NP (1)>

To a reaction vessel equipped with a condenser tube, a stirrer, and a nitrogen inlet tube, 400 parts of bisphenol A.EO dimolar adduct, 280 parts of bisphenol A.PO trimolar adduct, 300 parts of terephthalic acid, 40 parts of anhydrous phthalic acid, and 1.5 parts of dibuthyltin oxide as a polycondensation catalyst were poured, and the reaction was performed while distilling produced water away under nitrogen gas stream at 230° C. for 10 hours.

Next, the reaction was performed under reduced pressures of 5 mmHg to 20 mmHg, and when the acid value of the reactant was 2 or less, it was cooled to 180° C., then 62 parts of anhydrous trimellitic acid were added thereto, and the reaction was performed under sealed and normal pressure for 2 hours. After the reaction, the reactant was taken out from the reaction vessel, then cooled to room temperature and crushed to thereby obtain nonlinear polyester resin (NP (1)).

The nonlinear polyester resin (NP(1)) contained 5% tetrahydrofuran insoluble component and had an acid value of 20, a hydroxy group value of 47, a glass transition temperature (Tg) of 64° C., a melting point of 125° C., a number average molecular mass (Mn) of 4,100, a mass average molecular mass (Mw) of 75,000, and a peak top molecular mass of 10,200.

<Synthesis of Linear Polyester Resin P (2)>

To a reaction vessel equipped with a condenser, a stirrer, and a nitrogen inlet tube, 430 parts of bisphenol A.EO dimolar adduct, 300 parts of bisphenol A.PO dimolar adduct, 200 parts of terephthalic acid, 50 parts of fumaric acid, and 3 parts of dibutyltin oxide as a polycondensation catalyst were poured, and the reaction was performed while distilling produced water away under nitrogen gas stream at 220° C. for 10 hours. Next, the reaction was performed under reduced pressures of 5 mmHg to 20 mmHg, and when the acid value of the reactant was 4, it was taken out from the reaction vessel, then cooled to room temperature and crushed to thereby obtain linear polyester resin P (2).

The linear polyester resin P (2) did not contain tetrahydrofuran insoluble component and had an acid value of 4, a hydroxyl group value of 15, a glass transition temperature (Tg) of 60° C., a melting point of 105° C., a number average molecular mass (Mn) of 3,200, a mass average molecular mass (Mw) of 12,000, and a peak top molecular mass of 8,800.

<Preparation of Masterbatch>

Using the linear polyester resin P (1), pigments, the polyester resin, and pure water were mixed at a mixing ratio of 1:1:0.5 and kneaded with two rollers. The kneading was performed at 70° C., and then the roller temperature was raised to 120° C. to evaporate water to thereby produce a masterbatch preliminarily.

<Prescription of Cyan Toner Masterbatch: (TB-C2)>

| | |
|---|---|
| Binder resin P (2) | 100 parts |
| Cyan pigment (C.I pigment blue 15:3) | 100 parts |
| Pure water | 50 parts |

<Prescription of Magenta Toner Masterbatch: (TB-M2)>

| | |
|---|---|
| Binder resin P (2) | 100 parts |
| Magenta pigment (C.I pigment red 269) | 100 parts |
| Pure water | 50 parts |

<Prescription of Yellow Toner Masterbatch: (TB-Y (2))>

| | |
|---|---|
| Binder resin P (2) | 100 parts |
| Yellow pigment (C.I pigment yellow 180) | 100 parts |
| Pure water | 50 parts |

<Prescription of Black Toner Masterbatch: (TB-K2)>

| | |
|---|---|
| Binder resin P (2) | 100 parts |
| Black pigment (carbon black) | 100 parts |
| Pure water | 50 parts |

<Prescription of Cyan Toner>

| | |
|---|---|
| Linear polyester resin (P (2)) | 25 parts |
| Nonlinear polyester resin (NP (1)) | 30 parts |
| Hybrid resin (H (1)) | 15 parts |
| Masterbatch (TB-C2) | 20 parts |
| E-84 (salicylic acid zinc complex, manufactured by Orient Chemical Industries, Ltd. | 0.8 parts |
| Carnauba wax (acid value: 5 mgKOH/g, Mw: 1,600) | 7 parts |

<Prescription of Magenta Toner>

A magenta toner was produced with the same prescription of the cyan toner except that the content of the masterbatch (TB-M2) was changed to 18 parts and the content of the linear polyester resin (P (2)) was changed to 27 parts for use.

<Prescription of Yellow Toner>

A yellow toner was produced with the same prescription of the cyan toner except that the content of the masterbatch (TB-Y2) was changed to 20 parts.

<Prescription of Black Toner>

A black toner was produced with the same prescription of the cyan toner except that the content of the masterbatch (TB-K2) was changed to 16 parts and the content of the linear polyester resin (P (1)) was changed to 29 parts.

With the above prescription, each of toner particles of black, magenta, yellow, and cyan having a volume average particle diameter of 6.6 μm were obtained. Next, external additives were added in the same manner as Example 1 to produce a developer in the same manner as Example 1.

Example 3

A toner and a developer were produced in the same manner as Example 2 except that the yellow toner pigment was changed to C.I. pigment yellow 155.

Example 4

A toner and a developer were produced in the same manner as Example 1 except that the external additives of toner were changed as follows:

-Preparation of Spherical and Hydrophobic Silica-

Tetramethoxysilane was reacted with ammonium water at 50° C. to obtain a spherical silica according to the sol-gel method. After washing the silica with water, the silica was rinsed with methanol without drying operation to disperse the silica in a toluene, treated with hexamethyldisilasane (HMDS) to thereby obtain anhydrous oxide particles. The anhydrous oxide particles was stirred in methanol using an ultrasonic dispersing apparatus and then the number average particle diameter thereof measured using a laser diffraction particle size distribution analyzer was 120 nm.

-Addition of External Additives-

Relative to 100 parts of the toner base particles obtained in Example 1, 2 parts of hydrophobized silica (HDKH2000, manufactured by Clariant Japan K.K., the number average particle diameter=30 nm), 1 part of inorganic oxide particles, 1 part of titanium oxide (MT-150A, manufactured by TAYCA CORPORATION, the number average particle diameter=30 nm) were mixed in Oster Mixer at a rotation speed of 12,000 rpm for 1 minute and then sieved through a sieve of 75 μm mesh to obtain a toner.

Comparative Example 1

A toner and a developer were produced in the same manner as Example 2 except that the yellow toner pigment was changed to C.I pigment yellow 185.

Comparative Example 2

A toner and a developer were produced in the same manner as Example 2 except that the magenta toner pigment was changed to C.I. pigment red 122.

Comparative Example 3

A toner and a developer were produced in the same manner as Example 2 except that the magenta toner pigment was changed to C.I. pigment red 184.

Next, individual toners prepared in Examples 1 to 4 and Comparative Examples 1 to 3 were evaluated as to reproductivity of neutral colors and toner scattering within a main body of image forming apparatus as follows:

<Evaluation Method>

(1) Color Difference in L*a*b* Color Specification System

Using an image forming apparatus, respective image densities at a 100% image-area ratio in monochrome mode of yellow (Y), magenta (M), and cyan (C) were measured. For neutral colors for blue (B) and red (R), respective image densities when yellow (Y), magenta (M), and cyan (C) colors were respectively mixed at 50% were measured using X-Rite densitometer (manufactured by X-Rite Inc.), and when the densities of the colors were respectively 1.0, the color differences were measured using a color difference meter (CR-100, manufactured by KONICA MINOLTA).

(2) Toner Scattering in Copier

Using an image forming apparatus, after consecutively outputting 150,000 sheets of a 50% image-area ratio chart in monochrome mode, smears in the vicinity of the developing unit in the image forming apparatus were visually judged and ranked. When no smear was viewed, it was ranked as 5. When a little amount of smears were viewed, it was ranked as 4. When smears were obviously viewed, it was ranked as 3. When toner lay on the developing unit, it was ranked as 2. When toner lay and diffused to other places other than the image developing unit, it was ranked as 1. When the value is 4 or more, there is no problem in practical use.

Table 1 shows color difference in respective monochrome toners and powder properties.

TABLE 1

| | | Color Difference | | Shape Factor | Shape Factor | | Average particle diameter | |
|---|---|---|---|---|---|---|---|---|
| | | a* | b* | SF-1 | SF-2 | Dv/Dn | (μm) | Circularity |
| Example 1 | Y | −3.2 | 88.2 | 137 | 130 | 1.16 | 5.6 | 0.955 |
| | M | 72.2 | −2.9 | 135 | 127 | 1.18 | 5.7 | 0.956 |
| | C | −28.8 | −50.5 | 131 | 122 | 1.20 | 5.5 | 0.956 |
| Example 2 | Y | −6.8 | 88.0 | 157 | 139 | 1.22 | 6.5 | 0.925 |
| | M | 72.4 | −3.0 | 154 | 137 | 1.19 | 6.6 | 0.926 |
| | C | −28.9 | −50.6 | 156 | 141 | 1.21 | 6.5 | 0.925 |
| Example 3 | Y | −3.3 | 88.3 | 151 | 135 | 1.20 | 6.7 | 0.927 |
| | M | 72.5 | −3.5 | 155 | 136 | 1.22 | 6.7 | 0.925 |
| | C | −28.9 | −50.6 | 152 | 135 | 1.22 | 6.5 | 0.925 |
| Example 4 | Y | −6.9 | 88.1 | 158 | 138 | 1.21 | 6.5 | 0.928 |
| | M | 72.3 | −3.2 | 155 | 135 | 1.19 | 6.6 | 0.926 |
| | C | −28.8 | −50.5 | 154 | 138 | 1.21 | 6.7 | 0.927 |
| Compara. | Y | −4.0 | 86.0 | 151 | 136 | 1.22 | 6.8 | 0.926 |
| Ex. 1 | M | 72.2 | −3.0 | 154 | 136 | 1.19 | 6.4 | 0.928 |
| | C | −28.1 | −50.6 | 155 | 137 | 1.20 | 6.6 | 0.925 |

TABLE 1-continued

| | | Color Difference | | Shape Factor | Shape Factor | | Average particle diameter | |
|---|---|---|---|---|---|---|---|---|
| | | a* | b* | SF-1 | SF-2 | Dv/Dn | (μm) | Circularity |
| Compara. | Y | −6.8 | 88.4 | 157 | 135 | 1.20 | 6.3 | 0.925 |
| Ex. 2 | M | 69.0 | −10.1 | 156 | 133 | 1.21 | 6.4 | 0.927 |
| | C | −28.6 | −50.4 | 156 | 134 | 1.19 | 6.4 | 0.926 |
| Compara. | Y | −6.7 | 88.3 | 151 | 132 | 1.19 | 6.2 | 0.926 |
| Ex. 3 | M | 70.2 | −0.2 | 159 | 140 | 1.20 | 6.1 | 0.928 |
| | C | −28.8 | −50.5 | 152 | 132 | 1.21 | 6.2 | 0.925 |

Table 2 shows the evaluation results on reproductivity of neutral colors and toner scattering in a main body of image forming apparatus.

Figure 6:
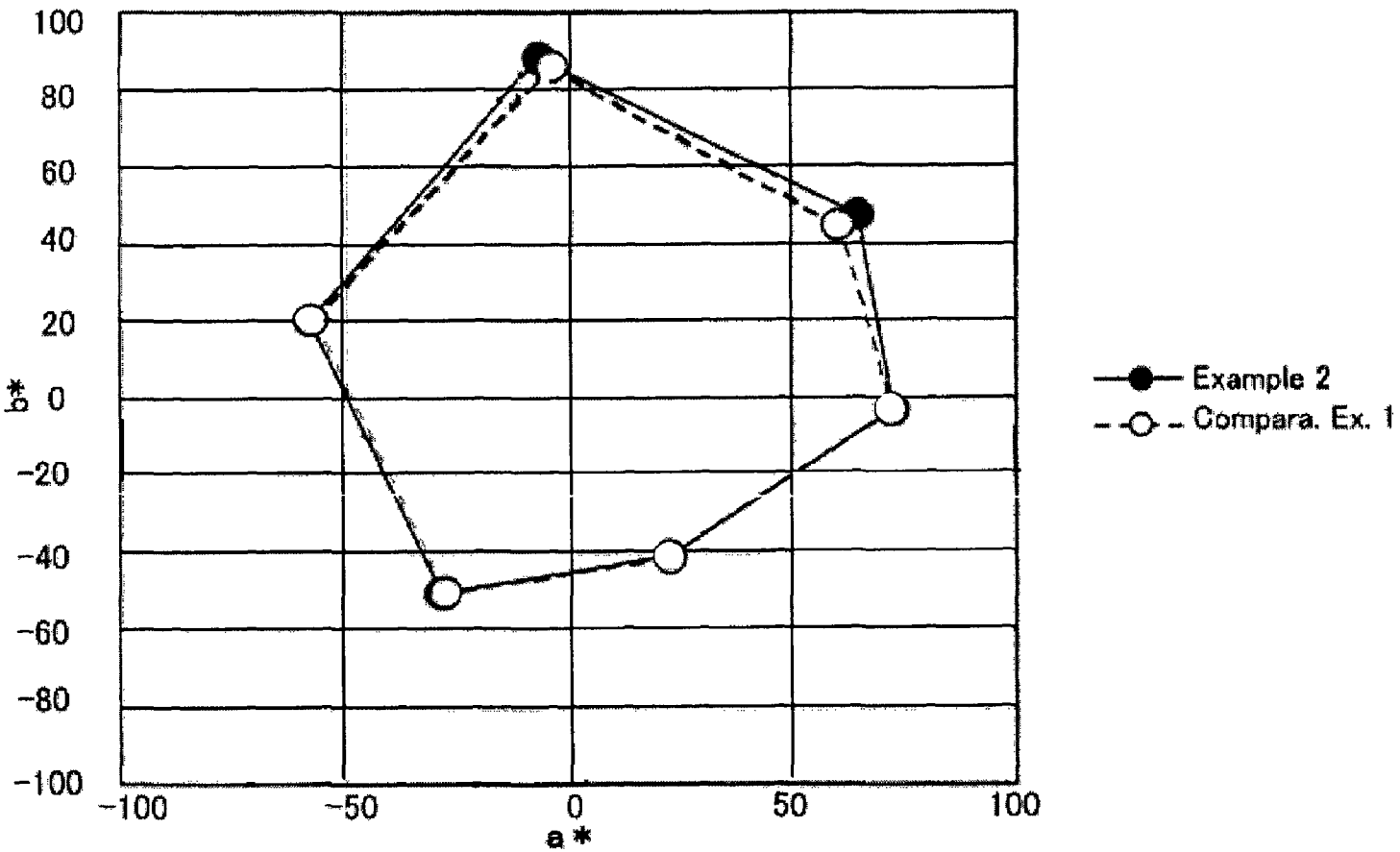
FIG. 6 is a view showing reproductivity of neutral colors with the color specification system of L*a*b*.
Figure 7:
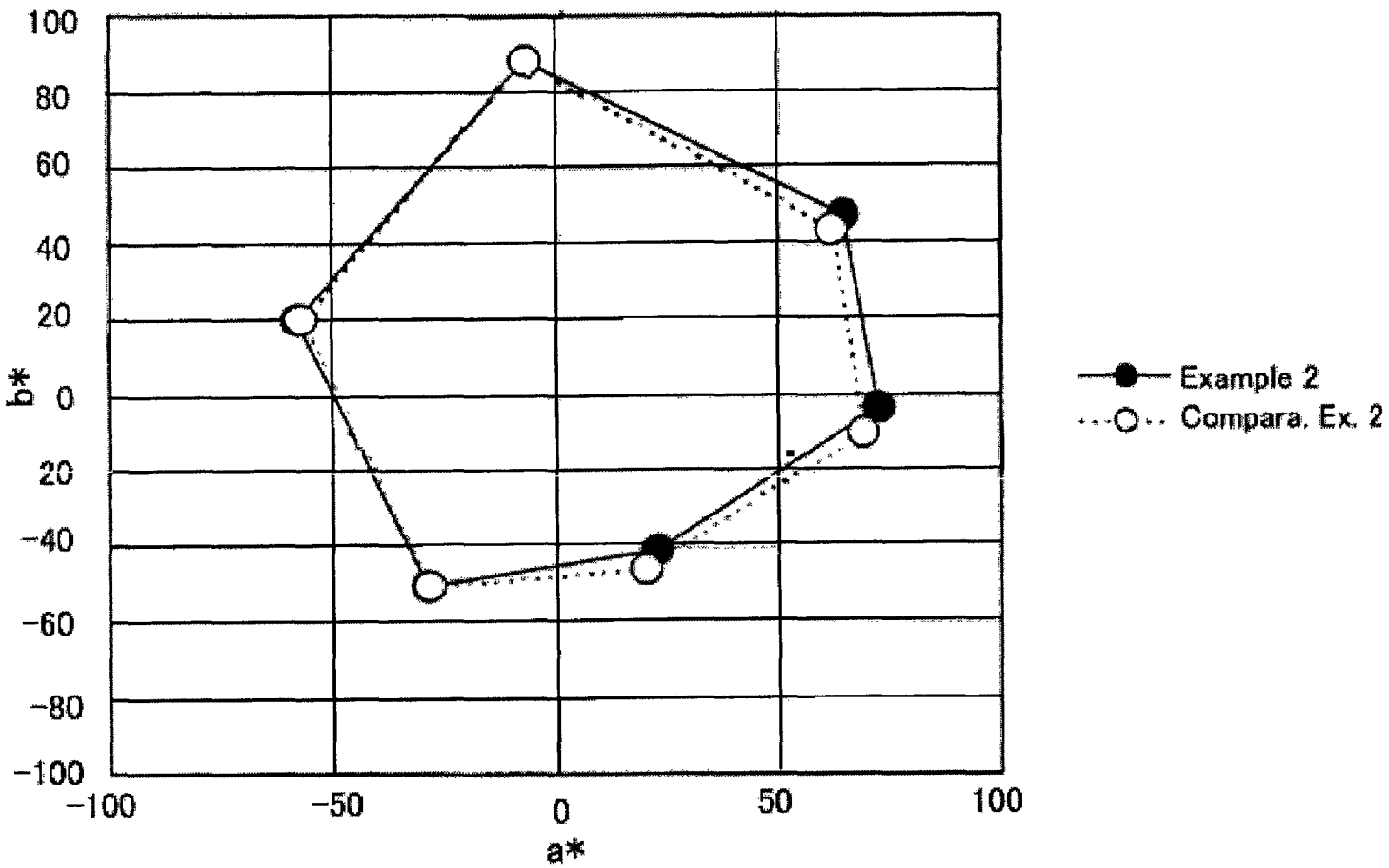
FIG. 7 is a view showing reproductivity of neutral colors with the color specification system of L*a*b*.
Figure 8:
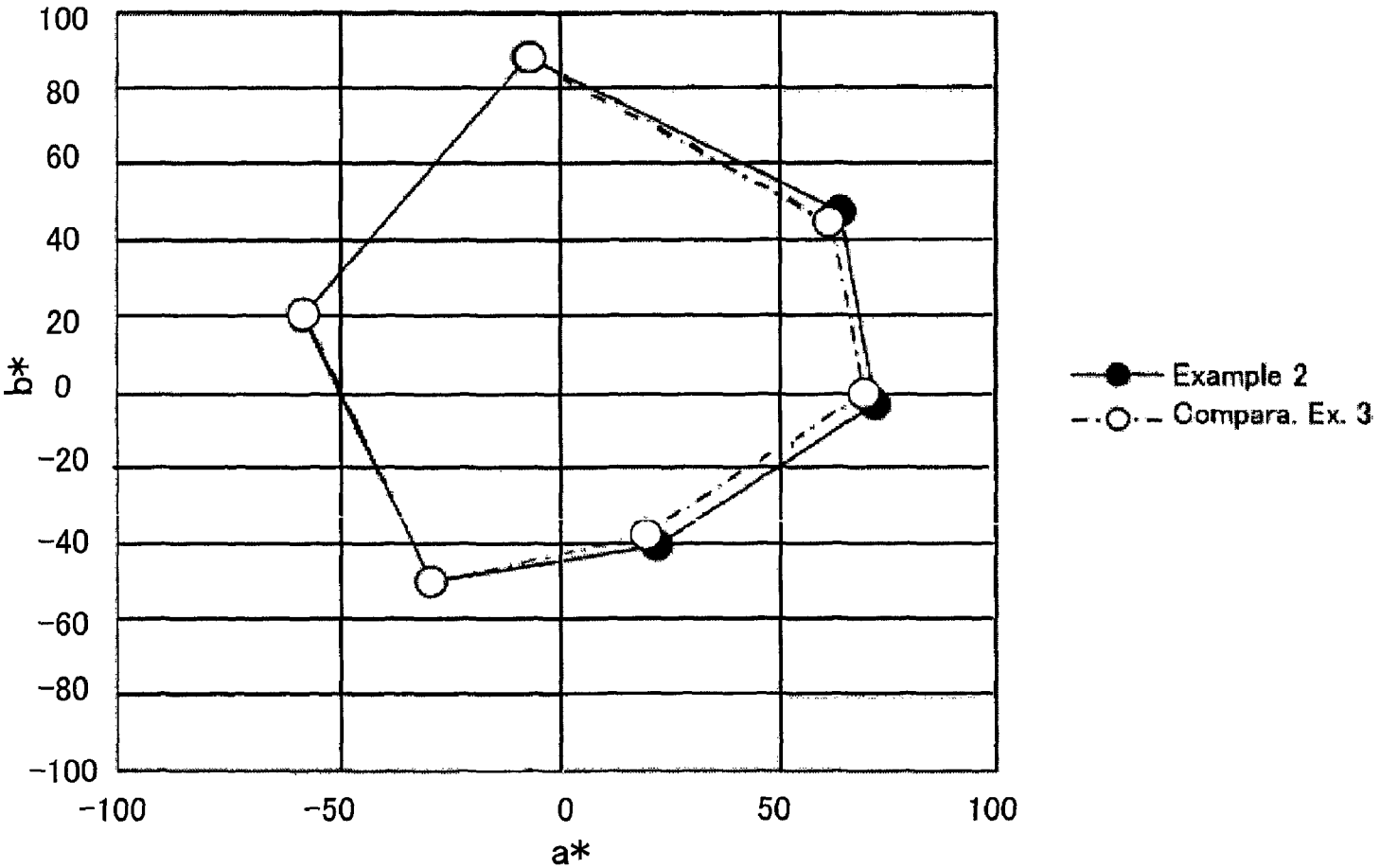
FIG. 8 is a view showing reproductivity of neutral colors with the color specification system of L*a*b*.

FIGS. 6, 7, and 8 show reproductivity of neutral colors with values of color specification system of L*a*b*, respectively.

TABLE 2

| | Color Difference in neutral colors (Red) | | Color Difference in neutral colors (Blue) | | Toner Scattering |
|---|---|---|---|---|---|
| | a* | b* | a* | b* | Rank |
| Example 1 | 64.2 | 51.2 | 23.1 | −41.2 | 4.5 |
| Example 2 | 64.6 | 47.4 | 22.4 | −41.0 | 4.0 |
| Example 3 | 64.4 | 51.4 | 23.3 | −41.3 | 4.0 |
| Example 4 | 64.8 | 47.5 | 22.6 | −41.1 | 4.5 |
| Compara. Ex. 1 | 59.8 | 44.7 | 22.5 | −41.2 | 3.5 |
| Compara. Ex. 2 | 61.9 | 43.9 | 20.0 | −46.0 | 3.0 |
| Compara. Ex. 3 | 61.8 | 44.7 | 19.8 | −37.9 | 3.0 |

The results shown in Table 2 demonstrated that toners according to Examples 1 to 4 respectively had a greater absolute value of color reproductivity of neutral colors in L*a*b* color specification system and a wider color reproduction range, compared to the toners according to Comparative Examples 1 to 3. FIGS. 6, 7, and 8 show evaluation results of color reproduction range of neutral colors using pulverized toners, and the results show that the toner of the present invention has wider color reproduction ranges in monochrome colors and in neutral colors.

It is also found that toners prepared according to Examples 1 to 4 respectively had a lesser amount of toner scattering in a copier compared to those prepared according to Comparative Examples 1 to 3.

From the results stated above, it is found that toners according to Examples 1 to 4 respectively had a wider color reproduction range and an excellent grade in toner scattering which is a practical issue in image forming apparatuses.

What is claimed is:

1. An image forming method comprising:

forming a latent electrostatic image on a latent electrostatic image bearing member, developing the latent electrostatic image using a toner comprising at least a hybrid resin, a linear polyester resin and a non-linear polyester resin to form a visible image comprising at least a red image, wherein the hybrid resin comprises a vinyl-type polymerizable unit and a polyester-type unit, transferring the visible image onto a recording medium, and fixing the transferred image on the recording medium, wherein in the visible image on the recording medium, a yellow toner layer is formed on a magenta toner layer, wherein the image forming method comprises three or more developing steps, developing units in the developing steps respectively comprise any one of a yellow toner, a magenta toner, and a cyan toner, the magenta toner comprises a pigment represented by the following Structural Formula (1), and the yellow toner comprises a pigment represented by at least any one of the following Structural Formulas (2) and (3)

Structural Formula (1)

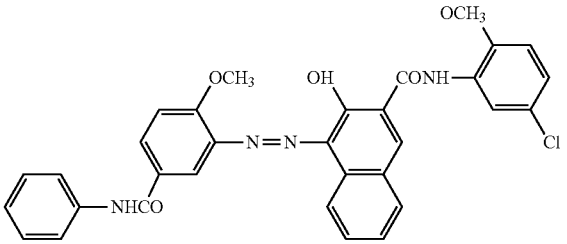

C.I. pigment red 269

Structual Formula (2)

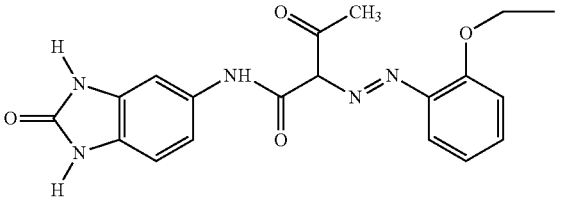

C.I. pigment yellow 180

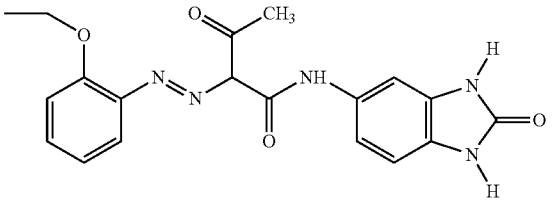

Structural Formula (3)

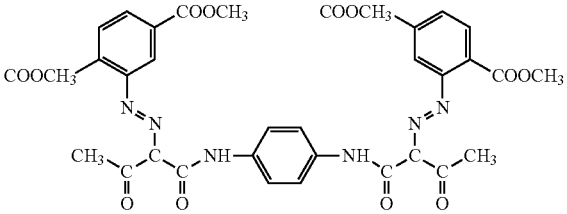

C.I. pigment yellow 155

2. The image forming method according to claim 1, wherein multiple color toners are sequentially superimposed to form a color image.

3. The image forming method according to claim 1, wherein the image forming method is a tandem type image forming method which comprises three or more image forming elements each of which comprises the latent electrostatic image bearing member, a latent electrostatic image forming unit, a developing unit, and a transferring unit.

* * * * *